US007470852B2

(12) United States Patent
Masuda

(10) Patent No.: US 7,470,852 B2
(45) Date of Patent: Dec. 30, 2008

(54) TONE GENERATOR CONTROL APPARATUS AND PROGRAM FOR ELECTRONIC WIND INSTRUMENT

(75) Inventor: Hideyuki Masuda, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 151 days.

(21) Appl. No.: 11/490,933

(22) Filed: Jul. 20, 2006

(65) Prior Publication Data

US 2007/0017346 A1 Jan. 25, 2007

(30) Foreign Application Priority Data

Jul. 25, 2005 (JP) ..... 2005-213736

(51) Int. Cl.
*G10H 3/14* (2006.01)

(52) U.S. Cl. ..... 84/615; 84/653; 84/723

(58) Field of Classification Search ..... 84/615, 84/628, 633, 629, 653, 658, 665, 678, 687, 84/704, 706, 711, 723
See application file for complete search history.

(56) References Cited

U.S. PATENT DOCUMENTS

| | | | | |
|---|---|---|---|---|
| 2,138,500 | A * | 11/1938 | Miessner | 84/723 |
| 2,301,184 | A * | 11/1942 | Arnold | 84/742 |
| 2,868,876 | A * | 1/1959 | Ticchioni | 381/70 |
| 3,429,976 | A * | 2/1969 | Tomcik | 84/730 |
| 3,439,106 | A * | 4/1969 | Goodale | 84/711 |
| 3,767,833 | A * | 10/1973 | Noble et al. | 84/673 |
| 3,897,708 | A * | 8/1975 | Suzuki | 84/678 |
| 3,938,419 | A * | 2/1976 | De Rosa | 84/678 |
| 4,085,646 | A * | 4/1978 | Naumann | 84/633 |
| 4,151,368 | A * | 4/1979 | Fricke et al. | 84/736 |
| 4,178,821 | A * | 12/1979 | Gallina et al. | 84/685 |
| 4,203,338 | A * | 5/1980 | Vidas | 84/678 |

(Continued)

FOREIGN PATENT DOCUMENTS

GB 2 221 078 A 1/1990

(Continued)

OTHER PUBLICATIONS

Study on Organ Pipe and Its Application to Underwater Sound Sources, Sounding Mechanism, Chapter 2.1, p. 13 to Chapter 2.4, p. 27.

(Continued)

*Primary Examiner*—David S. Warren
(74) *Attorney, Agent, or Firm*—Morrison & Foerster LLP

(57) ABSTRACT

Flow velocity sensor and a length sensor are provided on or near an edge of the lip plate which the air jet from the embouchure hole impinges against. Jet flow velocity Ue at the edge and a jet-blowout-outlet-to-edge distance d are detected by the sensors. Jet transfer time $\tau e$ is calculated by an equation of $\tau e = d/Ue$, and a jet traveling angle $\theta e'$ is calculated by an equation of $\theta e' = 2\pi fso1 \times \tau e$ (where fso1 represents a frequency of a tone to be generated). When $\theta e'$ has decreased to $\pi/2$ during tone generation in a primary mode, the mode changes to a secondary mode to raise the pitch of the currently generated tone by one octave. When $\theta e'$ has increased to $3\pi/4$ during tone generation in the secondary mode, the mode changes to the primary mode to lower the pitch of the currently generated tone by one octave.

10 Claims, 20 Drawing Sheets

U.S. PATENT DOCUMENTS

| | | | | | |
|---|---|---|---|---|---|
| 4,252,045 | A | * | 2/1981 | Nagura | 84/687 |
| 4,757,737 | A | * | 7/1988 | Conti | 84/681 |
| 4,915,008 | A | * | 4/1990 | Sakashita | 84/658 |
| 4,919,032 | A | * | 4/1990 | Sakashita | 84/653 |
| 4,939,975 | A | * | 7/1990 | Sakashita | 84/626 |
| 4,993,307 | A | * | 2/1991 | Sakashita | 84/615 |
| 4,993,308 | A | * | 2/1991 | Villeneuve | 84/724 |
| 5,010,801 | A | * | 4/1991 | Sakashita | 84/735 |
| 5,024,133 | A | * | 6/1991 | Nakanishi et al. | 84/615 |
| 5,036,745 | A | * | 8/1991 | Althof, Jr. | 84/656 |
| 5,069,106 | A | * | 12/1991 | Sakashita | 84/626 |
| 5,069,107 | A | * | 12/1991 | Sakashita | 84/659 |
| 5,117,729 | A | * | 6/1992 | Kunimoto | 84/660 |
| 5,149,904 | A | * | 9/1992 | Kamiya et al. | 84/723 |
| 5,189,240 | A | * | 2/1993 | Kawashima | 84/724 |
| 5,245,130 | A | | 9/1993 | Wheaton | |
| 5,286,913 | A | * | 2/1994 | Higashi | 84/622 |
| 5,340,942 | A | * | 8/1994 | Kunimoto | 84/661 |
| 5,498,836 | A | * | 3/1996 | Okamoto et al. | 84/658 |
| 5,543,580 | A | | 8/1996 | Masuda et al. | |
| 7,049,503 | B2 | * | 5/2006 | Onozawa et al. | 84/723 |
| 7,321,094 | B2 | * | 1/2008 | Sakurada | 84/616 |
| 2007/0017352 | A1 | * | 1/2007 | Masuda | 84/658 |

FOREIGN PATENT DOCUMENTS

| | | | |
|---|---|---|---|
| JP | 64-077091 | | 3/1989 |
| JP | 05-216475 | | 8/1993 |
| JP | 06-067675 | | 3/1994 |
| JP | 07-199919 | | 8/1995 |
| JP | 2002-049369 | | 2/2002 |
| SU | 690 543 | A1 | 10/1979 |

OTHER PUBLICATIONS

Chida K. et al., "Development of a New Anthropomorphic Flutist Robot WF-4", Robotics and Automation, 2004, Proceedings of the 2004 IEEE International Conference on Robotics & Automation, New Orleans, LA, Apr. 2004, pp. 152-158.

Yasuji Sawada et al., "On The Transition Between The Sounding Modes of a Flute", The Hournal of the Acoustical Society of America, vol. 67, No. 5, May 31, 1980, pp. 1790-1794.

* cited by examiner

TONE GENERATOR CONTROL APPARATUS AND PROGRAM FOR ELECTRONIC WIND INSTRUMENT

BACKGROUND OF THE INVENTION

The present invention relates to a tone generator control apparatus and program suited for application to electronic wind instruments.

Generally, with air-lead musical instruments, such as flutes and piccolos, there has been employed so-called "octave-specific playing" for properly playing two different tones, having a same pitch name but different in octave with a same fingering pattern or state. In FIG. 22, there are shown a fingering pattern or state for generating or sounding notes "E" of first and second octaves (indicated by A in the figure), and a fingering state for sounding notes "F" of the first and second octaves (indicated by B in the figure). For example, when notes "E" of the first and second octaves are to be generated with the fingering state shown in FIG. 22, a human player blows air relatively weakly for the E note of the first octave but blows air relatively strongly for the E note of the second octave. Embouchure too slightly differs between the first and second octaves.

Regarding the conventional air-lead musical instruments, such as organ pipes, there has been obtained various physical information about generation of tones (see, for example, "Study of Organ Pipe and its Application to Underwater Sound Source", by Shigeru Yoshikawa, doctoral thesis for Tokyo Institute of Technology, 1985; this literature will hereinafter be referred to as "Non-patent Literature 1"). FIG. 23 shows physical information about a tone generation section of a pipe organ. In the figure, reference character AF indicates an air flow input to the pipe organ's tone generation section, SL indicates a slit, and EG indicates an edge. Examples of the physical information include an initial velocity U(0) (m/s) of an air jet at an outlet of the slit SL, final velocity U(d) (m/s) of the jet at the edge EG, distance d (m) between the slit SL and the edge EG, time τe (sec) of air jet transfer from the slit to the edge, tone generating frequency fso (Hz), etc. In the figure, relationship between a distance x from the slit and jet flow velocity U(x) (flow velocity distribution of an air jet) is shown below the pipe organ's tone generation section. The jet flow velocity U(x) gradually lowers from the initial jet velocity U(0) to the final jet velocity U(d) as illustrated in FIG. 23.

In Non-patent literature 1, there is a description to the effect that a tone generating octave of the air lead of an air-lead musical instrument, such as a flute or organ pipe, can be determined by a current tone generation mode and traveling angle of an air jet. In Non-patent literature 1, the jet traveling angle θe can be expressed by Mathematical Expression 1 below using the above-mentioned jet transfer time τe and tone generating frequency fso (or tone generating angular frequency ωso=2π·fso).

$$\sigma e=\omega so\times\tau e \qquad \text{[Mathematical Expression 1]}$$

where ωso=2π·fso.

Further, the jet transfer time τe can be expressed by Mathematical Expression 2 below using the above-mentioned slit-to-edge distance d and jet flow velocity U(x).

$$\tau e=\int_0^d 1/U(x)dx \qquad \text{[Mathematical Expression 2]}$$

The jet transfer time τe can also be determined through the conventionally-known trapezoidal approximation method instead of the integral calculation of Mathematical Expression 2 above. Namely, The jet transfer time τe can also be determined by Mathematical Expression 3 below assuming that Ui indicates a jet flow velocity (m/s) at a distance x (=i·Δx (m) (i=1, 2, . . . n)) from the slit SL. The jet transfer time τe determined by Mathematical Expression 3 corresponds to an area Sd of a hatched section in FIG. 24. In order to accurately perform the calculation of Mathematical Expression 3 with a high accuracy, it is desirable that Δx be set at a sufficiently small value, such as 0.1 (cm) and the jet flow velocity be detected at many points.

$$\tau e \approx \sum_{i=1}^{n}(1/2)(1/U_{i-1}+1/U_i)\Delta x \qquad \text{[Mathematical Expression 3]}$$

FIG. 25 shows octave variation based on the tone generation mode and jet traveling angle θe, where the tone generation mode is shown as switchable between a primary mode and secondary mode. The primary mode is a mode in which a tone of a given pitch name is generated in a predetermined octave, while the secondary mode is a mode in which the tone generated in the primary mode is generated with the pitch raised by one octave.

Once a jet of an initial velocity U(0) is produced in a state $S_1$, tone generation in the primary mode is started at a time point $S_2$ where the jet traveling angle θe equals 3π/2 (θe=3π/2). Then, in a time period $S_3$ when the jet traveling angle θe degreases from π, through 3π/4, . . . , toward π/2, a tone generating frequency gradually increases so that a tone pitch and color are also caused to vary in an actual air-lead instrument, although not specifically described in Non-patent Literature 1. At a time point $S_4$ where the jet traveling angle θe equals π/2, the tone generation mode jumps to the secondary mode (one octave up). During the jump period $S_5$, the tone generating frequency doubles so that the jet traveling angle θe too doubles up to π.

Tone generation in the secondary mode is started at a time point $S_6$ when the jet traveling angle θe is π. Then, during a time period $S_7$ when the jet traveling angle θe increases from π to 3π/2, the tone generating frequency gradually decreases so that the tone pitch and color are also caused to vary, although not specifically described in Non-patent Literature 1. At a time point $S_8$ when the jet traveling angle θe equals 3π/2, the mode jumps to the primary mode (i.e., one octave down). During the downward jump period $S_9$, the tone generating frequency decreases by half, and thus, the jet traveling angle θe decreases by half to 3π/4. Note that the leftward direction in FIG. 25 is a direction in which the jet flow velocity U(x) increases and is also a direction in which the distance d between the slit and the edge decreases.

Regarding jet flow velocity distribution, it has been known, for example, that (a) the greater the initial jet velocity, the greater the attenuation of the jet flow velocity U(x) and that (b) in a case where the initial jet velocity is small and the distance d between the slit and the edge is small, the attenuation of the jet flow velocity U(x) may be ignored (see for example, "Experimental Consideration about Jet Flow Velocity Distribution and Tone Generating Characteristic of Air-lead Instrument", by Keita Arimoto, mater's thesis for Kyushu Institute of Design, 2001; this literature will hereinafter be referred to as "Non-patent Literature 2").

Further, there have been known tone generator control apparatus which control a physical model tone generator, simulative of an air-lead instrument, in response to operation on a keyboard (e.g., Japanese Patent Application Laid-open Publication No. HEI-67675 corresponding to U.S. Pat. No. 5,521,328; this publication will hereinafter be referred to as "Patent Literature 1"). Also known are various types of wind instruments provided with a mouse piece or other air-blowing (or playing) input section, such as the type where an air flow is detected via a breath sensor to control a start and end of tone generation (e.g., Japanese Patent Application Laid-open Publication No. SHO-64-77091; this publication will hereinafter be referred to as "Patent Literature 2"); the type where tone-characteristic switching control is performed in accordance with an intensity of breath (e.g., Japanese Patent Application Laid-open Publication No. HEI-5-216475; this publication will hereinafter be referred to as "Patent Literature 3"); the type where a tone pitch is controlled in accordance with a direction of exhaled or expiratory air blown into the mouse piece (e.g., Japanese Patent Application Laid-open Publication No. HEI-7-199919; this publication will hereinafter be referred to as "Patent Literature 4"); and the type where tone pitch information and tone volume information is obtained from a flow velocity of expiratory air blown into the mouse piece and total amount of the expiratory air, respectively (e.g., Japanese Patent Application Laid-open Publication No. 2002-49369; this publication will hereinafter be referred to as "Patent Literature 5").

The electronic musical instrument disclosed in Patent Literature 1 above is constructed to create control information of a thickness, flow velocity, inclination, etc. of a jet on the basis of key operation information acquired from a keyboard, then convert the control information into tone generator control parameters and thence supply these tone generator control parameters to a physical model tone generator. With the thus-constructed electronic musical instrument, it is not possible to execute a performance in accordance with blowing inputs to the mouse piece.

The electronic musical instruments disclosed in Patent Literature 2 to Patent Literature 5, on the other hand, are capable of executing a performance in accordance with blowing inputs, but they do not permit different playing styles to properly play different octaves (i.e., "octave-specific playing styles") as played with an ordinary flute or other air-lead instrument. It would be conceivable to permit different playing styles to properly play different octaves (octave-specific playing styles) by applying the information and technique disclosed in Non-patent literature 1; however, in the case where the information and technique disclosed in Non-patent literature 1 is applied as-is, the following problems would be encountered.

(1) If octave-switching control is performed on the basis of a current tone generating mode and jet traveling angle $\theta e$, there arises a need to acquire an actual tone generating frequency and substitute the thus-acquired actual tone generating frequency into Mathematical Expression 1 above. However, because the electronic musical instruments are not natural musical instruments. it is not possible to acquire such an actual tone generating frequency.

(2) In order to obtain a jet transfer time $\tau e$ with a high accuracy, it is necessary to sense a jet flow velocity at a number of points; however, it is practically difficult to position a number of flow velocity sensors along a jet flow path.

SUMMARY OF THE INVENTION

In view of the foregoing, it is an object of the present invention to provide a novel tone generator control apparatus for an electronic wind instrument which can readily simulate octave-specific playing styles of an air-lead instrument.

According to a first aspect of the present invention, there is provided a tone generator control apparatus, which comprises: a tubular body section having an elongated cavity communicating with its open end, the tubular body section having, on an outer peripheral surface thereof, a lip plate having an embouchure hole communicating with the cavity and a plurality of pitch-designating tone keys; a first detection section provided, on or near an edge of the lip plate against which an air jet from the embouchure hole impinges, for detecting a flow velocity or intensity of the air jet; a second detection section provided, on or near the edge of the lip plate, for detecting a length of the air jet; a jet transfer time determination section that, on the basis of detection outputs of the first detection section and the second detection section, determines a jet transfer time required for transfer of the air jet between a jet blowout outlet and the edge of the lip plate; a fingering detection section that detects a fingering state on the plurality of tone keys; a designation section that designates a frequency of a tone signal of a predetermined pitch name of a predetermined octave to be generated in correspondence with the fingering state detected by the fingering detection section; a calculation section that calculates a jet parameter corresponding to a product between the frequency designated by the designation section and the jet transfer time determined by the determination section; a first control section that, on the basis of the detection output of the first detection section, controls a tone generator section to generate the tone signal of the predetermined octave; a second control section that, upon detecting that the jet parameter calculated by the calculation section has decreased to a first predetermined value during generation, by the tone generator section, of the tone signal of the predetermined octave, controls the tone generator section to raise a pitch of the tone signal, currently being generated, by one octave; and a third control section that, upon detecting that the jet parameter calculated by the calculation section has increased to a second predetermined value, greater than the first predetermined value, during generation, by the tone generator section, of the tone signal of the pitch having been raised by one octave, controls the tone generator section to lower the pitch of the tone signal, currently being generated, by one octave.

In the tone generator control apparatus of the present invention, a flow velocity or intensity of an air jet is detected by the first detection section provided, on or near the edge of the lip plate while the length of the jet is detected by the second detection section, and a jet transfer time required for transfer of the air jet between the jet blowout outlet and the edge of the lip plate is determined on the basis of the detection outputs of the first and second detection sections. Further, a fingering pattern or state on the plurality of tone keys is detected, and a frequency of a tone signal to be generated in correspondence with the detected fingering state is designated. Jet parameter, such as a jet traveling angle, is calculated on the basis of the designated frequency and determined jet transfer time, and then a tone generating octave is controlled on the basis of the jet parameter and current tone generating state.

The first control section controls the tone generator section to generate a tone signal of a predetermined pitch name of a predetermined octave which corresponds to the detected fingering state. The second control section detects that the calculated jet parameter has decreased to the first predetermined value during generation, by the tone generator section, of the tone signal of the predetermined octave, and, in response to the detection, it controls the tone generator section to raise the pitch of the currently-generated tone signal by one octave. Further, the third control section detects that the calculated jet parameter has increased to the second predetermined value, greater than the first predetermined value, during generation, by the tone generator section, of the tone signal of the pitch having been raised by one octave, and, in response to the detection, it controls the tone generator section to lower the pitch of the currently-generated tone signal.

According to the present invention, the jet parameter is calculated using the frequency of the tone signal to be generated in correspondence with the detected fingering state, and thus, there is no need to acquire an actual tone generating frequency. Further, during generation of a tone signal of a predetermined octave, the tone generating octave is raised by one octave once it is detected that the calculated jet parameter has decreased to the first predetermined value; thus, after a user or human player plays in such a manner that the jet parameter reaches the first predetermined value, a tone signal higher in pitch by one octave can be generated with the user keeping the same playing (i.e., air-blowing) state, so that particular playing (i.e., air-blowing) operation for increasing the jet traveling angle from $\pi/2$ to $\pi$ is not required. Further, during generation of the tone signal having been raised in pitch by one octave, the tone generating octave is lowered by one octave once it is detected that the calculated jet parameter has increased to the second predetermined value greater than the first predetermined value; thus, after the user or human player plays in such a manner that the jet parameter reaches the second predetermined value, a tone signal lower in pitch by one octave can be generated with the user keeping the same playing (i.e., air-blowing) state, so that particular playing (i.e., air-blowing) operation for decreasing the jet traveling angle from $3\pi/2$ to $3\pi/4$ is not required. In this way, the present invention can readily perform octave-specific playing styles. Further, the present invention imparts a hysteresis characteristic to the octave switching by setting the second predetermined value greater than the first predetermined value. Therefore, no octave change occurs as the human player plays in such a manner as to slightly change the pitch as long as the change is within a range where the jet parameter does not reach the first predetermined value (when the pitch is to be raised by one octave) or within a range where the jet parameter does not reach the second predetermined value (when the pitch is to be lowered by one octave); thus, the present invention permits various rendition styles, such as a pitch bend and vibrato. As a result, the tone generator control apparatus according to the first aspect of the present invention can properly deal with embouchures of various flute-performing methods and therefore suits users who want to enjoy playing that is close to playing of a flute.

In the tone generator control apparatus according to the first aspect of the invention, the first detection section may include a plurality of flow velocity sensors provided for detecting the flow velocity of the air jet along a jet flow path extending from the jet blowout outlet to the edge or to a region near the edge. The jet transfer time determination section may include an estimation section that, on the basis of outputs of the plurality of flow velocity sensors, estimates flow velocity distribution of the air jet from the jet blowout outlet to the edge, and a distance determination section that, on the basis of the detection output of the second detection section, determines a distance between the jet blowout outlet and the edge. Thus, the jet transfer time determination section can determine the jet transfer time on the basis of the flow velocity distribution estimated by the estimation section and the distance determined by the distance determination section. In another embodiment, the jet transfer time determination section may include a storage section that stores flow velocity distribution data, indicative of flow velocity distribution of the air jet from the jet blowout outlet to the edge or to a region near the edge, for each detection output value of the first detection section, a readout section that reads out, from the storage section, the flow velocity distribution data corresponding to a detection output value of the first detection section, and a distance determination section that, on the basis of the detection output of the second detection section, determines a distance between the jet blowout outlet and the edge. Thus, the jet transfer time determination section can determine the jet transfer time on the basis of the flow velocity distribution indicated by the flow velocity distribution data read out from the storage section and the distance determined by the distance determination section. In another embodiment, the jet transfer time determination section may include a storage section that stores time data, indicative of a time required for transfer of the air jet between the jet blowout outlet and the edge of the lip plate, for each detection output value of the first detection section and for each detection output value of the second detection section, and a readout section that reads out, from the storage section, the time data corresponding to detection output values of the first and second detection sections. Thus, the jet transfer time determination section can determine, as the jet transfer time, the time data read out from the storage section. In another embodiment, the jet transfer time determination section may include a flow velocity determination section for determining a flow velocity of the air jet at the edge of the lip plate on the basis of the detection output of the first detection section, and a distance determination section that, on the basis of the detection output of the second detection section, determines a distance between the jet blowout outlet and the edge. Thus, the jet transfer time determination section can calculate the jet transfer time by dividing the distance determined by the distance determination section by the flow velocity determined by the flow velocity determination section. With such arrangements, the jet transmission time can be determined with a high accuracy with a reduced number of the flow velocity sensors.

The tone generator control apparatus according to the first aspect of the invention may further comprise: a fourth control section that, during generation, by the tone generator section, of the tone signal of the predetermined octave, controls the tone generator section to gradually raise the frequency of the tone signal as the jet parameter calculated by the calculation section decreases toward the first predetermined value, and a fifth control section that, during generation, by the tone generator section, of the tone signal of the pitch having been raised by one octave, controls the tone generator section to gradually raise the frequency of the tone signal as the jet parameter calculated by the calculation section increases toward the second predetermined value. With such arrangements, it is possible to simulate slow variation in tone generating frequency before and after an octave change in an actual air-lead instrument. Thus, the user or human player can feel a sign of an octave change and thereby smoothly perform octave-specific playing.

According to a second aspect of the present invention, there is provided a tone generator control apparatus, which comprises: a tubular body section having an elongated cavity communicating with its open end, the tubular body section having, on its outer peripheral surface, a lip plate having an embouchure hole communicating with the cavity and a plurality of pitch-designating tone keys; a first detection section provided, on or near an edge of the lip plate which an air jet from the embouchure hole impinges against, for detecting a flow velocity or intensity of the air jet; a second detection section provided, on or near the edge of the lip plate, for detecting a length of the air jet; a distance determination section that, on the basis of the detection output of the second detection section, determines a distance between the jet blowout outlet and the edge; a fingering detection section that detects a fingering state on the plurality of tone keys; a first control section that controls a tone generator section to generate a tone signal of a predetermined pitch of a predetermined octave, corresponding to the fingering state detected by the fingering detection section, on the basis of the detection output of the first detection section; a second control section that, upon detecting that the distance determined by the distance determination section has decreased to a predetermined value during generation, by the tone generator section, of the tone signal of the predetermined octave, controls the tone generator section to raise a pitch of the tone signal, currently being generated, by one octave; and a third control section that, upon detecting that the distance determined by the distance determination section has increased above the predetermined value during generation, by the tone generator section, of the tone signal of the pitch having been raised by one octave, controls the tone generator section to lower the pitch of the tone signal, currently being generated, by one octave.

In the tone generator control apparatus according to the second aspect of the present invention, the tubular body section, first and second detection sections, fingering state detection section and first control section are similar in construction to those in the tone generator control apparatus according to the first aspect of the present invention. However, the tone generator control apparatus according to the second aspect is different from the tone generator control apparatus according to the first aspect in that octave-switching control is performed using the distance between the jet blowout outlet and the edge, rather than the jet parameter, such as the jet traveling angle. Namely, the distance determination section determines a distance between the jet blowout outlet and the edge on the basis of the detection output of the second detection section. The second control section detects that the determined distance has decreased to the predetermined value during generation, by the tone generator section, of the tone signal of the predetermined octave, and, in response to the detection, it controls the tone generator section to raise the pitch of the currently-generated tone signal by one octave. The third control section detects that the determined distance has increased above the predetermined value during generation, by the tone generator section, of the tone signal of the pitch having been raised by one octave, and, in response to the detection, it controls the tone generator section to lower the pitch of the currently-generated tone signal by one octave.

Namely, in the tone generator control apparatus according to the second aspect of the present invention, once the distance between the jet blowout outlet and the edge has decreased to the predetermined value during generation, by the tone generator section, of the tone signal of the predetermined octave, the tone generating octave is raised by one octave, while, once the distance between the jet blowout outlet and the edge has increased above the predetermined value during generation, by the tone generator section, of the tone signal having been raised in pitch by one octave, the tone generating octave is lowered by one octave. Thus, the present invention permits octave-specific playing by only changing the lip-to-edge distance and therefore is very suitable for beginners. With the above-described tone generator control apparatus according to the first aspect of the invention, the user is allowed to enjoy playing close to playing of a flute; however, it is difficult to execute a performance in great tone volume in a low pitch range because there is a tendency that no tone is generated unless the jet flow velocity is reduced, and it is difficult to execute a performance in small tone volume in a high pitch range because there is a tendency that no tone is generated unless the jet flow velocity is increased. However, with the above-described tone generator control apparatus according to the second aspect of the present invention, where the octave-switching control is performed using the distance between the jet blowout outlet and the edge rather than the jet parameter, such as the jet traveling angle, it is possible to execute not only a performance in great volume in a low pitch range but also a performance in small tone volume in a high pitch range.

In an embodiment, the tone generator control apparatus according to the second aspect may further comprise a storage section that stores an octave-switching controlling threshold value for each fingering state detected by the fingering detection section; and a supply section that reads out, from the storage section, the threshold value corresponding to the fingering state detected by the fingering detection section and supplies the read-out threshold value to the second and third control sections as the predetermined value. With such arrangements, the tone generator control apparatus of the invention is very suitable for users familiar with the technique or method of changing the lip-to-edge distance in accordance with the tone pitch.

With the octave-switching control performed on the basis of the current tone generating state and jet parameter as stated above, the tone generator control apparatus of the present invention can accomplish the advantageous benefit that octave-specific playing styles of an air-lead instrument, such as a flute, can be appropriately simulated with an utmost ease. Further, with the octave-switching control performed on the basis of the current tone generating state and jet-blowout-outlet-to-edge distance as stated above, the tone generator control apparatus of the present invention advantageously permits not only octave-specific playing but also a performance in great volume in a low pitch range and a performance in small volume in a high pitch range, by only changing the lip-to-edge distance.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

Figure 1:
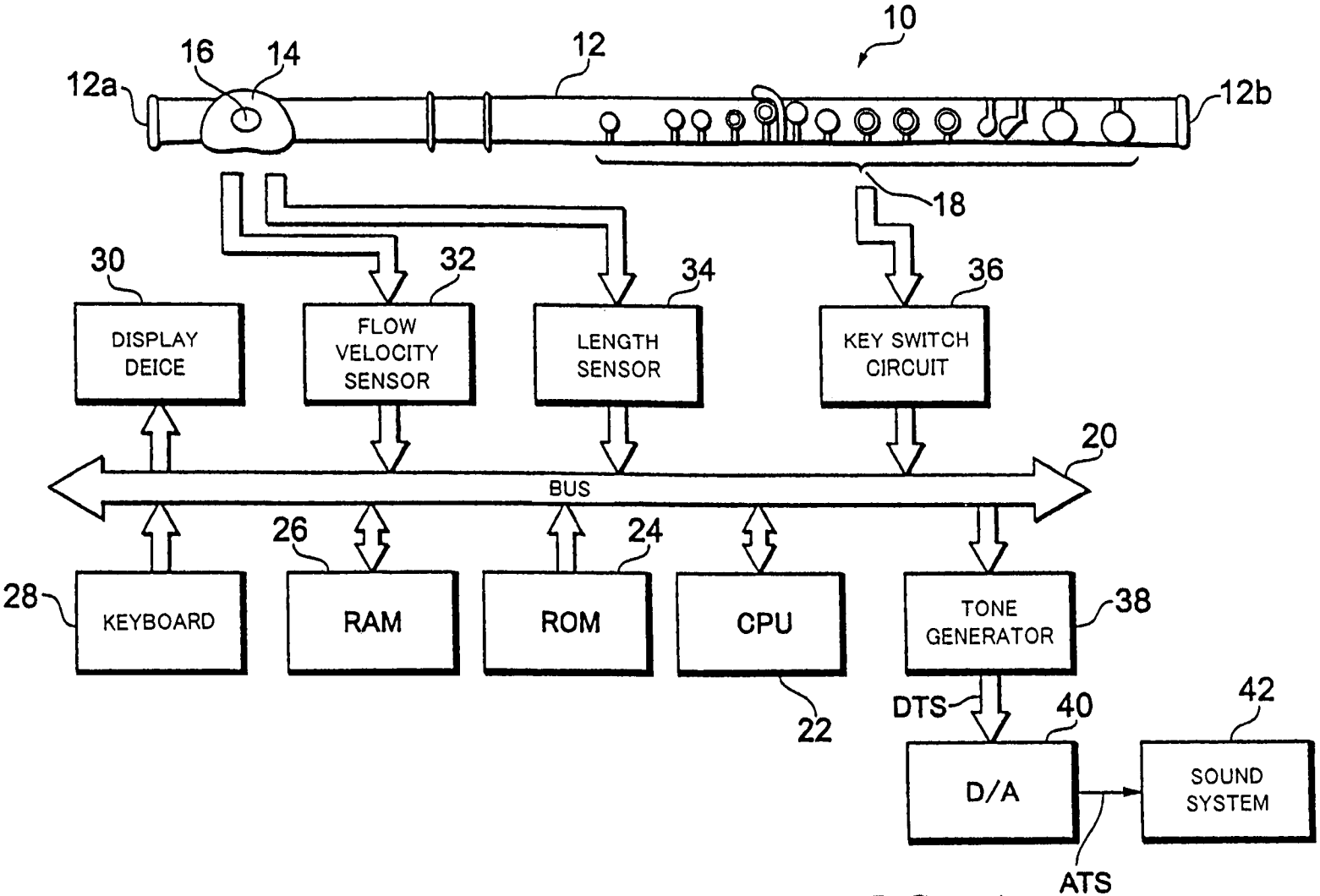
FIG. 1 is a block diagram showing an example circuit construction of an electronic wind instrument in accordance with an embodiment of the present invention.

FIG. 1 is a block diagram showing an example circuit construction of an electronic wind instrument in accordance with an embodiment of the present invention, where tone generator control is performed using a small-sized computer.

Wind controller 10, similar in shape to a flute, includes a tubular body section 12 having an elongated cavity extending from a closed end 12*a* to an open end 12*b*. On an outer peripheral surface of the tubular body section 12, there are provided a lip plate 14 having a blow hole or embouchure hole 16 communicating with the cavity of the tubular body section 12, and a tone key group 18 including a plurality of pitch-designating tone keys. The wind controller 10 does not generate a tone per se as a flute does, and thus, any suitable size of the tubular body section 12 may be set with user's usability etc. taken into account. The closed end 12*a* may be replaced with an open end.

The lip plate 14 has attached thereto a flow velocity sensor for detecting a velocity of an air jet and a length sensor for detecting a length of the jet. Structure for attaching these sensors will be later described with reference to FIGS. 4 and 5. Key switch is attached to each of the tone keys of the tone key group 18 for detecting whether the tone key has been operated.

To the bus 20 are connected a CPU (Central Processing Unit) 22, ROM (Read-Only Memory) 24, RAM (Random Access Memory) 26, keyboard 28, display device 30, flow velocity sensor circuit 32, length sensor circuit 34, key switch circuit 36, tone generator circuit 38, etc. The CPU 22 executes various processes for tone generator control in accordance with programs stored in the ROM 24. These processes will be later detailed with reference to FIGS. 9-14. In the ROM 24, various data tables are prestored in addition to programs. The RAM 26 includes storage regions to be used as flags, registers, etc. as the CPU 22 performs various processes. The keyboard 28 includes keys for a human operator or user to enter letters, numerals, etc., and a pointing device, such as a mouse. The display device 30 is provided for displaying various information.

The flow velocity sensor circuit 32 includes the flow velocity sensor attached to the lip plate 14 and generates flow velocity data corresponding to the output of the flow velocity sensor. The length sensor circuit 34 includes the length sensor attached to the lip plate 14 and generates length data corresponding to the output of the length sensor. The key switch circuit 36 includes a multiplicity of key switches provided in corresponding relation to the tone keys of the tone key group 18, and it generates fingering data corresponding to a fingering pattern or state of the tone key group 18.

Figure 2:
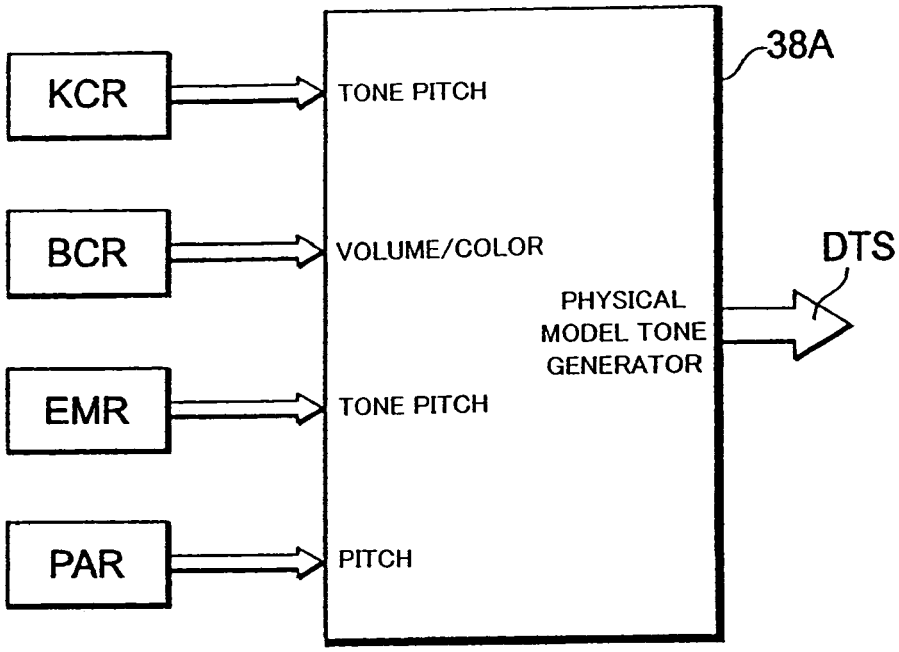
FIG. 2 is a block diagram showing an example of a tone generator circuit.

The tone generator circuit 38 includes, for example, a physical model tone generator 38A as illustrated in FIG. 2, and digital tone signals DTS are generated from the physical model tone generator 38A. The physical model tone generator 38A is supplied with a key code value from a register KCR as a tone pitch control input, a breath control value from a register BCR as a tone volume/color control input, an embouchure control value from a register EMR as a tone pitch control input and a pitch correction value from a register PAR as a pitch control input. The above-mentioned registers KCR, BCR, EMR and PAR are each provided with the RAM 26. The tone pitch control input is an input for controlling a tone pitch in half tones in accordance with a scale, the pitch control input is an input for controlling a tone pitch in cents as in a pitch bend or the like. The tone generator circuit 38 may include a waveform table tone generator (waveform readout tone generator) 38B as illustrated in FIG. 38, as will be later described.

Each digital tone signal DRS generated from the tone generator circuit 38 is converted into an analog tone signal ATS via a D/A converter circuit 40. The analog tone signal ATS is converted into a tone via a sound system 42 including a power amplifier, speaker, etc.

Figure 4:
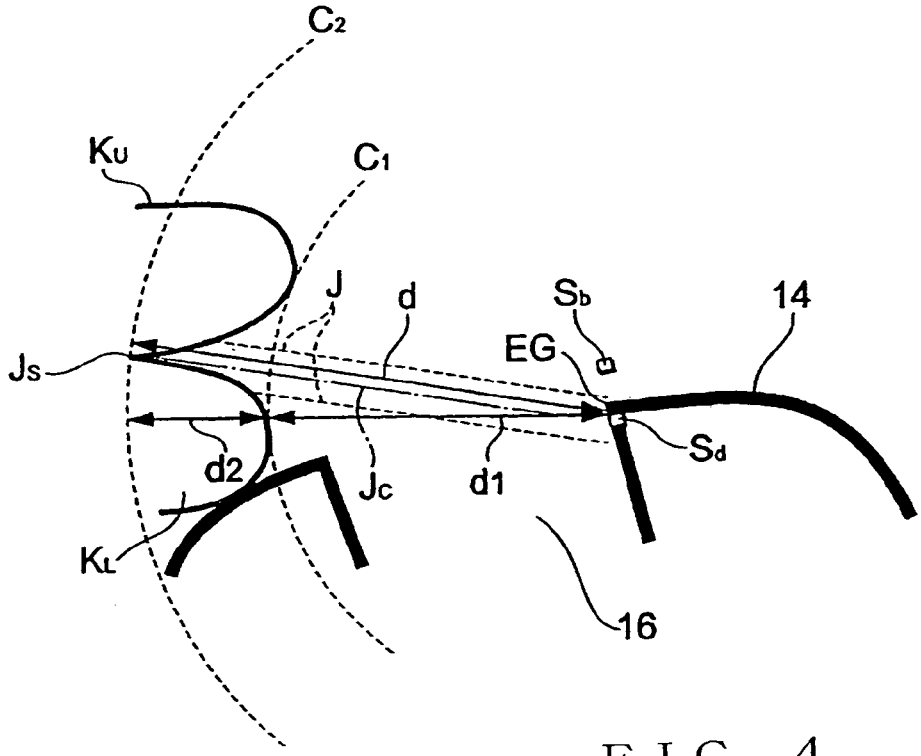
FIG. 4 is a sectional view showing an example manner in which a flow velocity sensor and length sensor are mounted.
Figure 5:
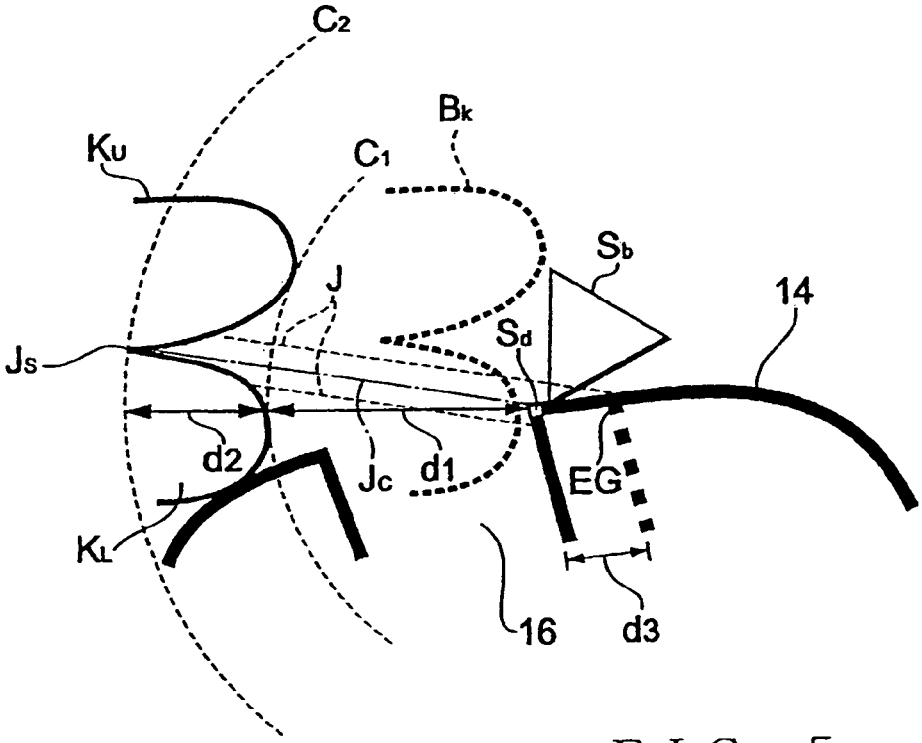
FIG. 5 is a sectional view showing another example manner in which the flow velocity sensor and length sensor are mounted.

FIG. 4 shows an example manner in which the flow velocity sensor and length sensor are mounted. The flow velocity sensor Sb is provided near an edge EG of the lip plate 14 against which a jet impinges through the embouchure hole. Further, the length sensor Sd is provided immediately below the edge EG. The flow velocity sensor Sb has a small size so as not to hinder the jet length detecting operation of the length sensor Sd. The length sensor Sd may be constructed to, for example, irradiate emitted light from a light emitting element to the lower lip $K_L$ of a human player or user and receive a reflection of the radiated light, to thereby detect a length of the jet J that corresponds to a distance d1 between the lower lip and the edge EG. Reference character Jc indicates a center of a thickness of the jet J.

Figure 23:
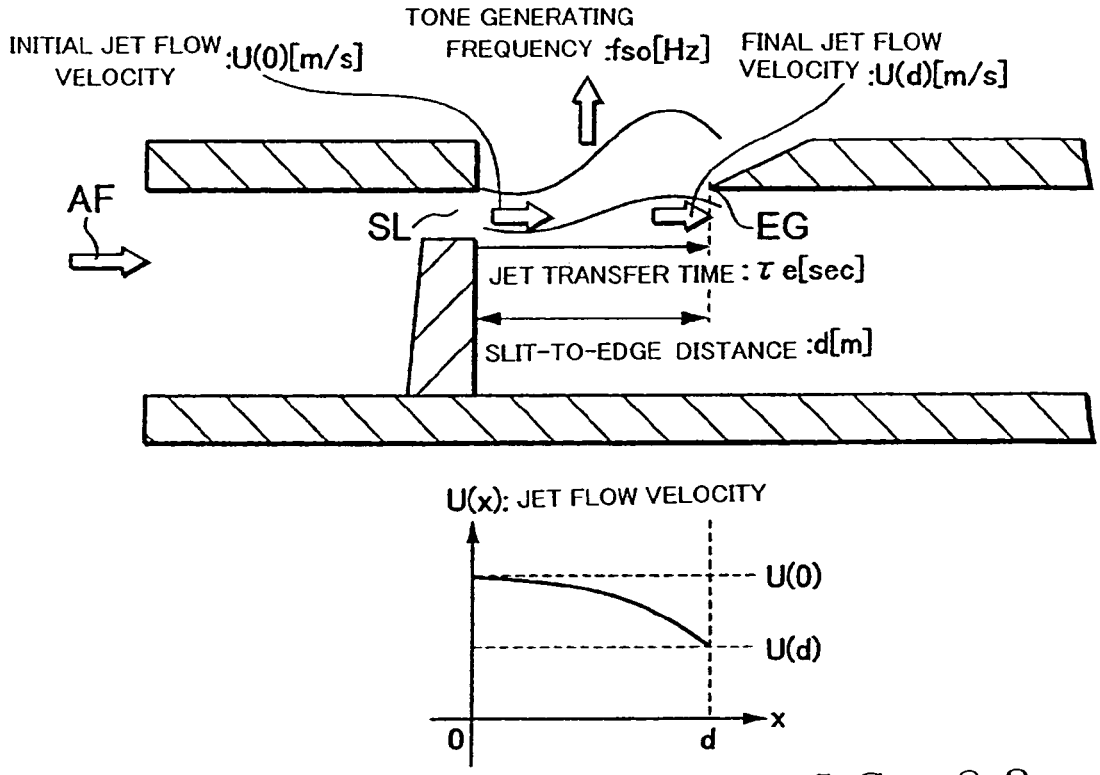
FIG. 23 is a sectional view showing an air jet flow in an air-lead instrument.

Jet blowout outlet Js represents an opening between the upper and lower lips $K_U$ and $K_L$. Considering a circular arc $C_1$ centering around the edge EG and passing the tip end of the lower lip $K_L$ and a circular arc $C_2$ centering around the edge EG and passing the jet blowout outlet Js, a distance d between the jet blowout outlet Js and the edge EG is greater than the above-mentioned distance d1 between the lower lip $K_L$ and the edge EG by a distance d2 between the jet blowout outlet Js and the tip of the lower lip $K_L$. Namely, the distance d can be determined by "d=d1+d2". The jet-blowout-outlet-to-edge distance d corresponds to the slit-to-edge distance d of FIG. 23 and is used to determine a jet transfer time τe and a degree of closeness of the lip to the edge EG of the lip plate 14. Because the distance d2 gets smaller as the tone pitch becomes higher, it is desirable that the distance d2 be determined (or scaled in accordance with the tone pitch), but the distance d2 may be set at a constant value averaged for all tone pitches.

Fig, 5 shows another example manner in which the flow velocity sensor and length sensor are mounted, where the same elements as in FIG. 4 are indicated by the same reference characters as in FIG. 4 and will not be explained here to avoid unnecessary duplication. In the illustrated example of FIG. 5, the flow velocity sensor Sb is in the form of a funnel-shaped sensor of a relatively great size provided more inward of the embouchure hole 16 than the edge EG of the lip plate 14. If the length sensor Sd is provided in the manner as shown in FIG. 4, the detecting operation of the length sensor Sd will be hindered by the flow velocity sensor Sb. Thus, in this case, the length sensor Sd is located immediately before the flow velocity sensor Sb in contact with the lower end of the flow velocity sensor Sb. Broken lines Bk shows the upper and lower lips $K_U$ and $K_L$ having come closest to the edge EG of the lip plate 14. If a distance between the length sensor Sd and the edge EG is given as d3, the jet-blowout-outlet-to-edge distance d can be determined by "d=d1+d2+d3".

Figure 6:
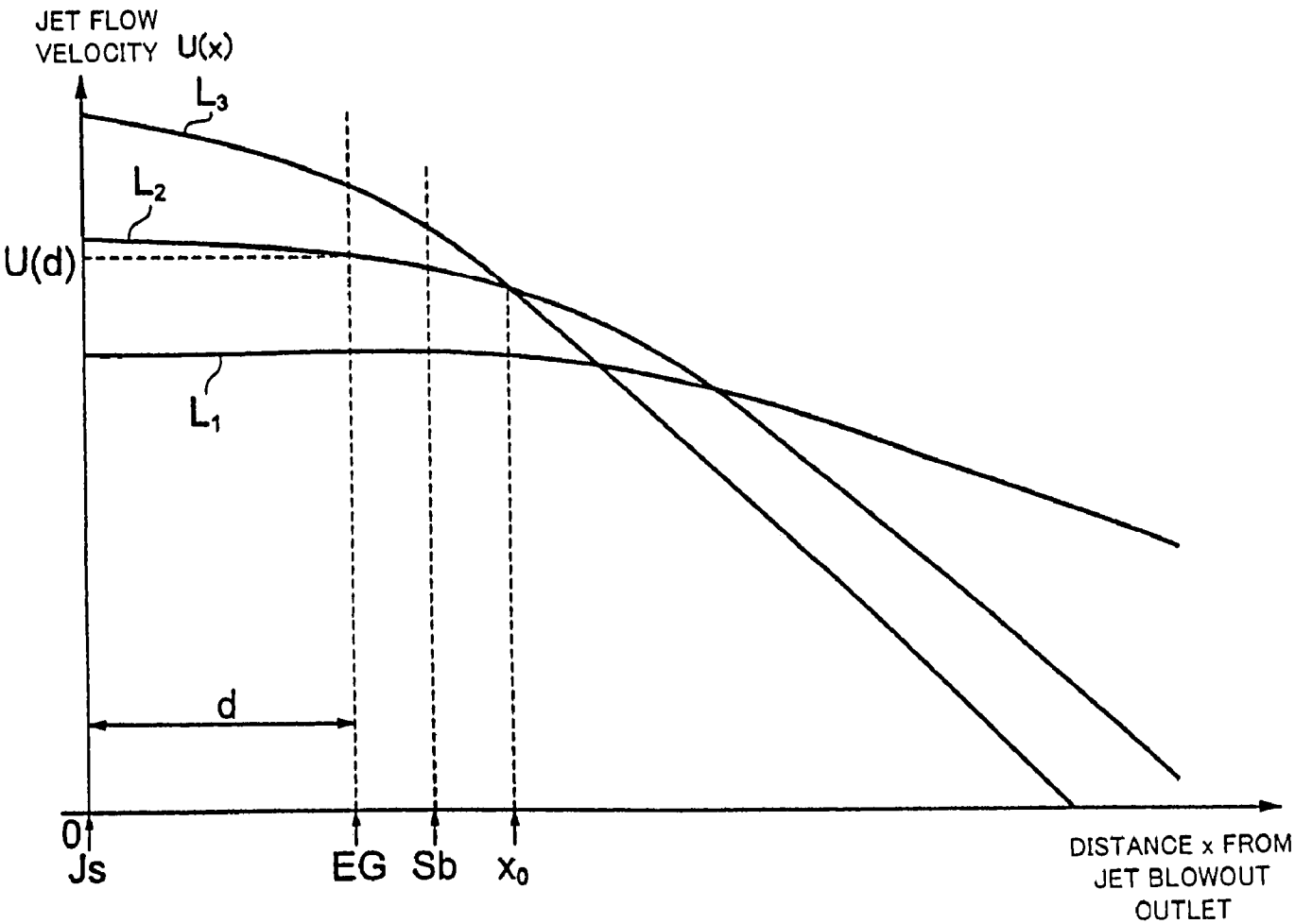
FIG. 6 is a flow speed distribution diagram explaining how to calculate a jet transfer time.

Next, a description will be given about how the jet transfer time is calculated in the instant embodiment, with reference to FIG. 6. In FIG. 6, the horizontal axis represents the distance x from the jet blowout outlet, while the vertical axis represents the jet flow velocity U(x). Lines $L_1$, $L_2$ and $L_3$ respectively indicate jet flow velocity distribution corresponding to low, medium and high initial jet velocities. On the horizontal axis, Js indicates the position of the jet blowout outlet, EG the position of the edge of the lip plate 14, Sb the position of the flow velocity sensor, $X_0$ the position corresponding to an intersection point between the lines $L_2$ and $L_3$, and d the distance between the jet blowout outlet and the edge of the lip plate 14. As noted above in relation to FIGS. 4 and 5, the distance d is determined on the basis of the output from the length sensor Sd. In order to uniquely determine a jet flow velocity U(d) at the position of the edge EG, it is necessary to provide the flow velocity sensor Sb to the left of the position $X_0$ (i.e., closer to the edge EG than the position $X_0$).

Figure 24:
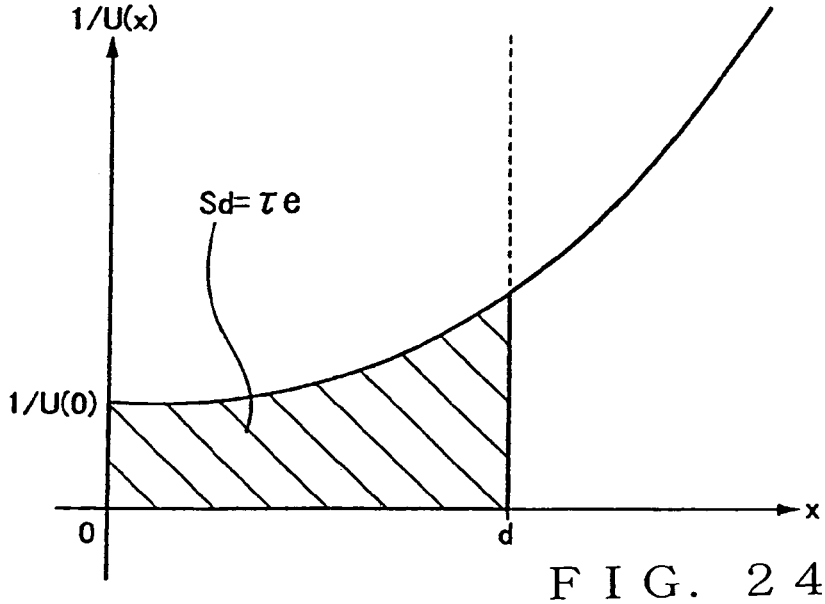
FIG. 24 is a flow speed distribution diagram explaining how to calculate an air jet transfer time.

In order to determine the jet transfer time τe with a high accuracy using the method explained above in relation to FIGS. 23 and 24, a number of the flow sensors would be required. However, if any one of the following methods ($M_1$)-($M_4$) is used, the jet transfer time τe can be determined with a high accuracy using a reduced number of the flow sensors.

($M_1$) Method in which flow velocity distribution is estimated on the basis of outputs of a plurality of the flow velocity sensors: according to this method, the flow velocity sensors are provided along a jet flow path extending from the jet blowout outlet to the edge of the lip plate or the neighborhood of the edge. For example, two, i.e. first and second, flow velocity sensors are provided, the first flow velocity sensor at the position "EG" of FIG. 6 and the second flow velocity sensor at the position "Sb" of FIG. 6. Jet flow velocity distribution, such as the one represented by the line $L_2$, is estimated on the basis of the outputs of the first and second flow velocity sensors and using, for example, the interpolation, collinear approximation or curve approximation schemes. Then, the jet transfer time τe is calculated, on the basis of the estimated jet flow velocity distribution and distance d, using Mathematical Expression 2 or 3 mentioned earlier in the Background of the Invention section of the specification.

($M_2$) Method in which flow velocity distribution data are tabled and stored in a memory in advance: according to this method, there is used one flow velocity sensor is provided near the edge EG as illustrated in FIG. 4. Further, flow velocity distribution data, indicative of jet flow velocity distribution from the jet blowout outlet to the edge EG or neighborhood of the edge EG are obtained through actual measurement and then tabled and stored in the ROM 24 in advance in association with output values of the flow velocity sensor. In a performance, the flow velocity distribution data corresponding to an output value of the flow velocity sensor is read out from the ROM 24, and the jet transfer time τe is calculated, on the basis of the read-out flow velocity distribution data and distance d, using Mathematical Expression 2 or 3.

($M_3$) Method in which previously-calculated jet transfer times are tabled and stored in a memory in advance: according to this method, a time required for transfer of an air jet between the jet blowout outlet and the edge of the lip plate (i.e., jet transfer time) is calculated on the basis of flow velocity distribution and distance d as in the above-described method ($M_2$), and time data of the calculated time are tabled and stored in the ROM 24 in advance in association with output values of the flow velocity sensor and length sensor. In a performance, the time data corresponding to output values of the flow velocity sensor and length sensor is read out from the ROM 24, and the time indicated by the read-out time data is determined as the jet transfer time τe.

($M_4$) Method in which a jet transfer time is calculated in a simplified manner: according to this method, a jet transfer time τe is calculated using the jet flow velocity U(d) at the position of the edge and distance d and a simplified mathematical expression of "τe=d/U(d)". This method is based on the assumption that the initial jet velocity U(0) and final velocity U(d) are substantially equal to each other (U(0)≈U(d)), and it is suitable for use when flow velocity distribution has a small initial velocity U(0) as indicated by the line $L_1$.

Figure 7:
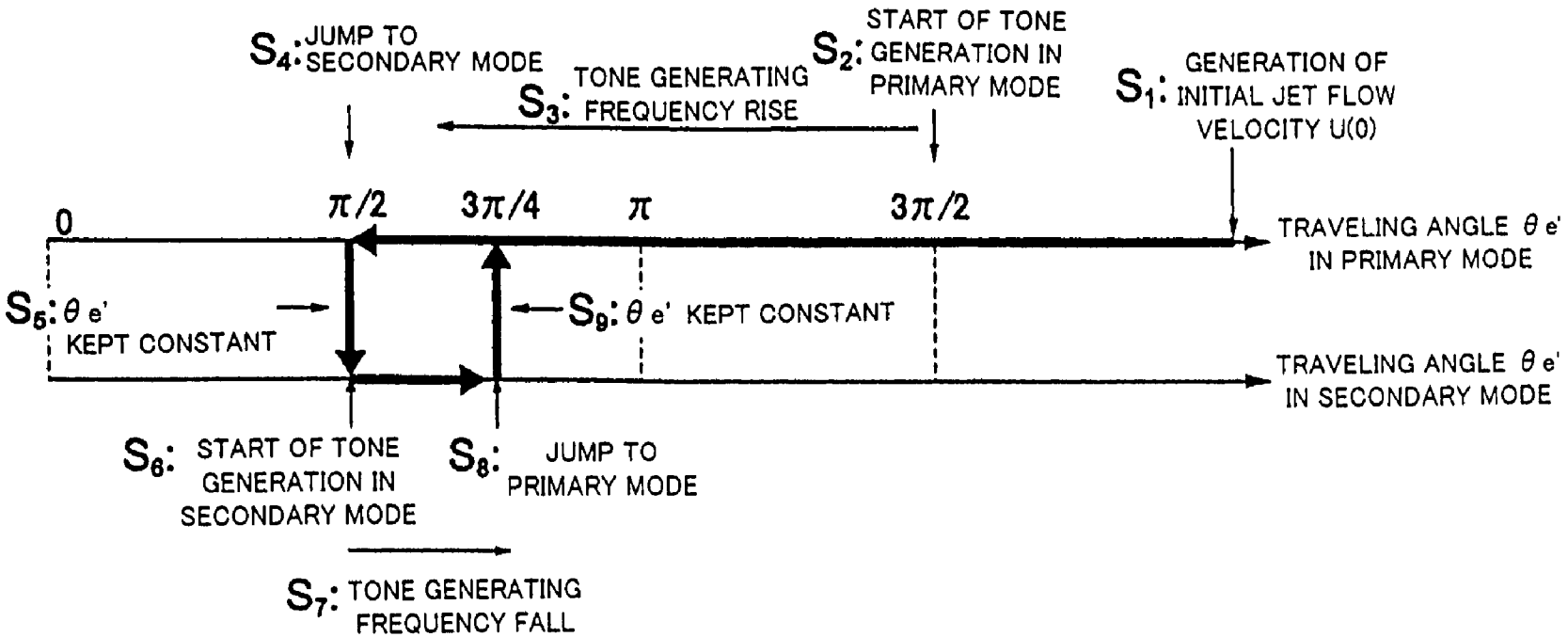
FIG. 7 is a mode transition diagram showing octave switching control in accordance with the present invention.
Figure 25:
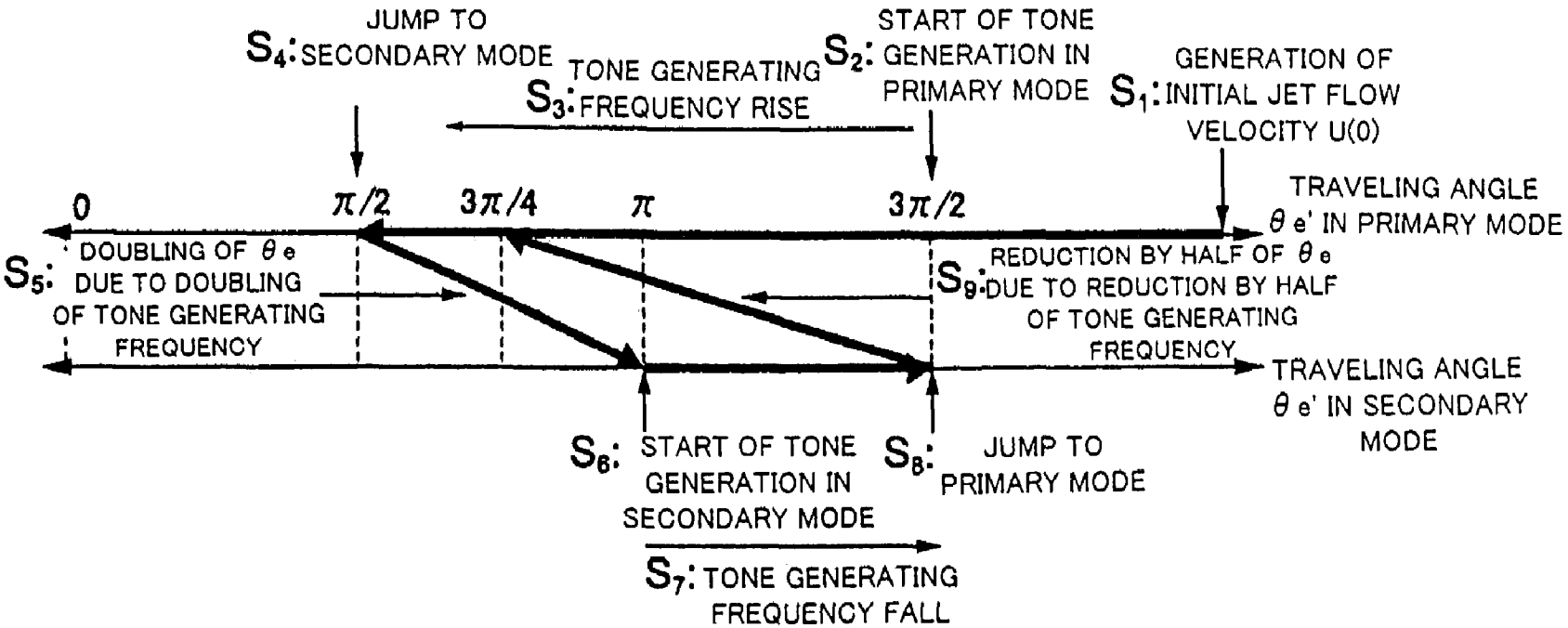
FIG. 25 is a mode transition diagram showing octave switching control in an air-lead instrument.
Figure 26:
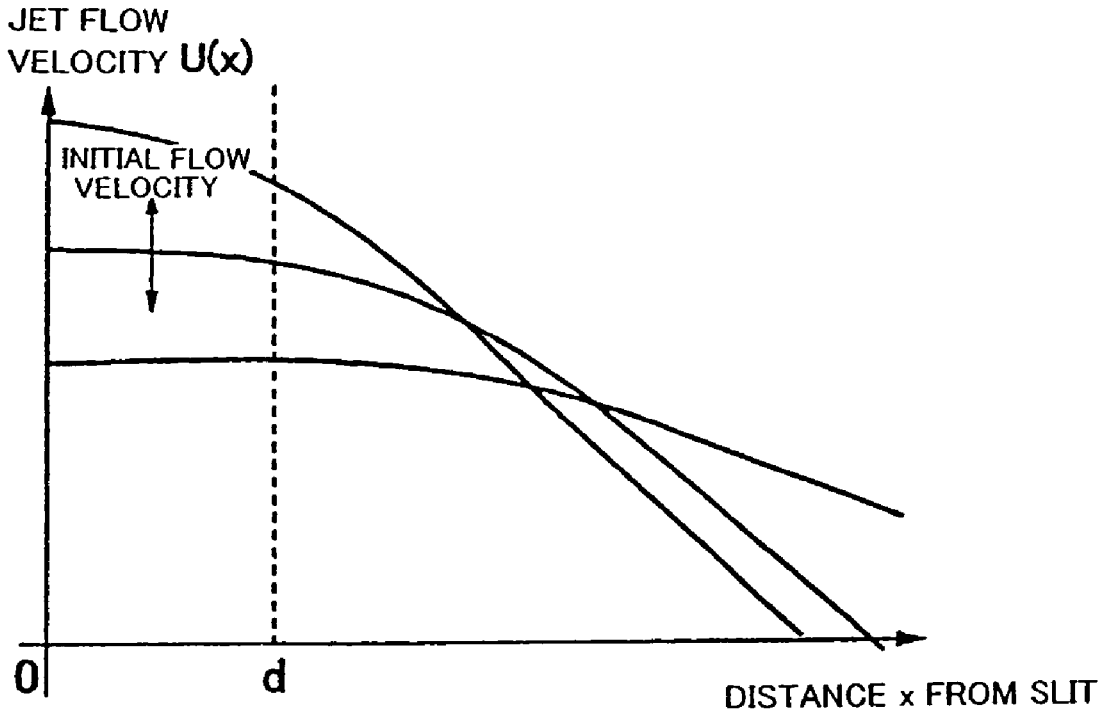
FIG. 26 is a diagram showing air jet flow speed distribution in an air-lead instrument.

FIG. 7 is a mode transition diagram similar to FIG. 25, which shows octave switching control in accordance with the present invention. Jet traveling angle θe' is equal to the traveling angle θe of FIG. 25 in the primary mode, but half of the traveling angel θe of FIG. 25 (θe/2) in the secondary mode. Once a jet of an initial velocity U(0) is produced at a time point $S_1$, tone generation in the primary mode is started at a time point $S_2$ where the jet traveling angle θe' becomes 3π/2. Then, in a time period $S_3$ when the jet traveling angle θe' degreases from π through 3π/4, . . . , toward π/2, a tone generating frequency is gradually raised so that a tone pitch and color are also caused to vary. At a time point $S_4$ when the jet traveling angle θe' becomes π/2, the mode jumps to the secondary mode (i.e., one octave up). During the upward jump period $S_5$, the jet traveling angle θe' is kept at π/2, and thus, there is required no air-blowing operation for doubling the traveling angle from π/2 to π as shown in FIG. 25.

Tone generation in the secondary mode is started in a state $S_6$ where the jet traveling angle θe' is π/2. Then, in a time period $S_7$ when the jet traveling angle θe' increases from π/2 to 3π/4, the tone generating frequency is gradually lowered so that the tone pitch and color are also caused to vary. At a time point $S_8$ when the jet traveling angle θe' becomes 3π/4, the mode jumps to the primary mode (i.e., one octave down). During the downward jump period $S_9$, the jet traveling angle θe' is kept at 3π/4, and thus, there is required no blowing operation for reducing the traveling angle by half from 3π/2 to 3π/4 as shown in FIG. 25. Note that the leftward direction in FIG. 7 is a direction in which the jet flow velocity U(x) increases and is also a direction in which the distance d between the jet blowout outlet and the edge EG decreases.

In the illustrated example, where the jet traveling angle θe' in the secondary mode is half of the jet traveling angle θe of FIG. 25 (π/2 or 3π/4), it is easier to determine a start of tone generation in the secondary mode and a shift to the primary mode. Further, because the same fingering state may be maintained when the tone generating octave is raised or lowered by one octave, the frequency of a tone signal of a predetermined pitch name of a predetermined octave. to be generated in correspondence with the same fingering state, can be used as the frequency for determining the jet traveling angle θe', and thus, no actual tone generating frequency has to be used.

Figure 8:
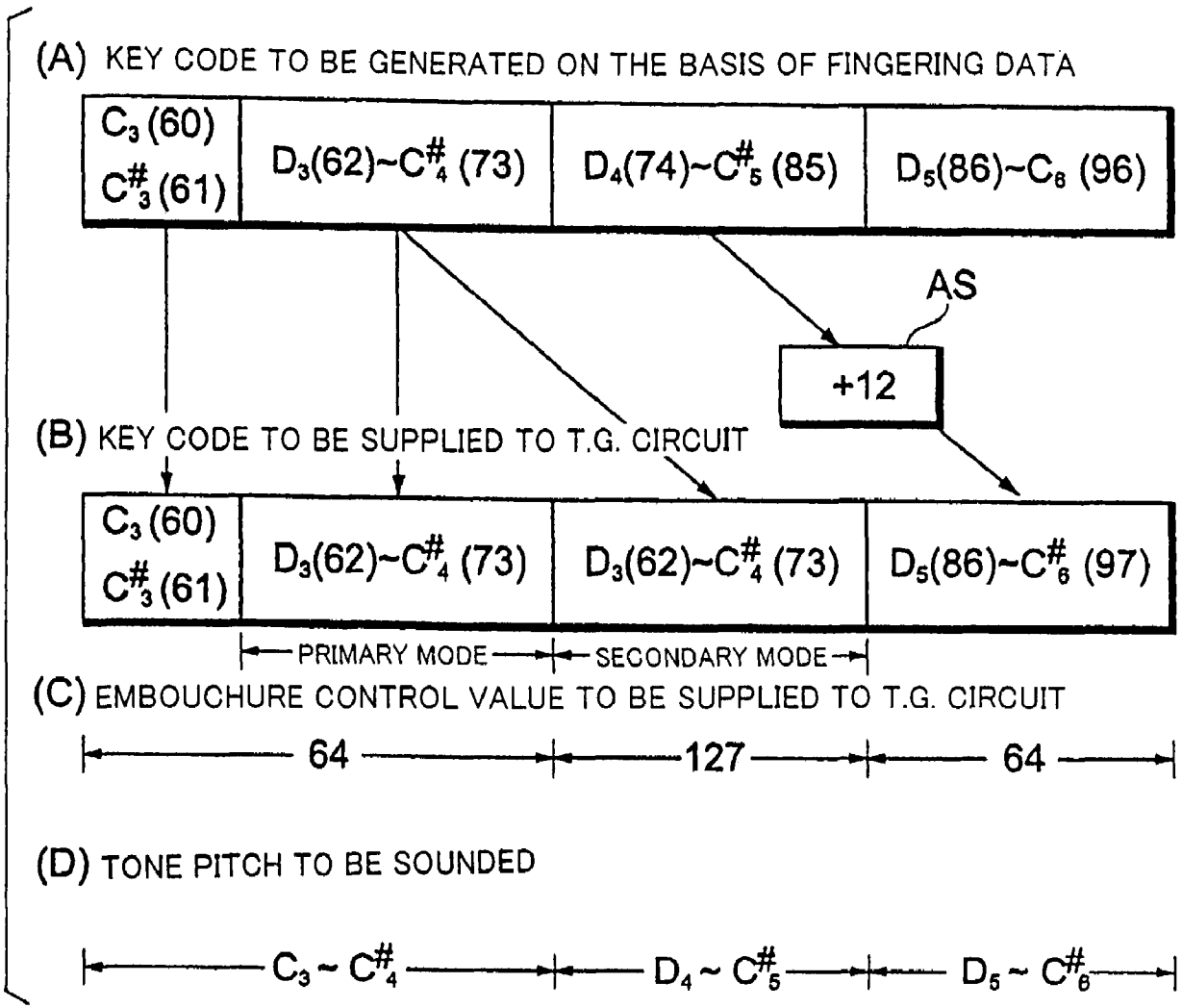
FIG. 8 is a diagram explanatory of tone generation processing based on key codes.

FIG. 8 shows how tones are generated in the instant embodiment on the basis of key codes, where (A) shows key codes generated on the basis of fingering data, (B) shows key codes to be supplied to the tone generator circuit 38, (C) shows embouchure control values to be supplied to the tone generator circuit 38 and (D) shows tone pitches to be generated. In the figure, the key code are each indicated as a key code value (note number) in parentheses.

The key code values "60" and "61" are supplied to the tone generator circuit 38 along with the embouchure control value "64" and used to generate tones "$C_3$" and "$C\#_3$". For the key code values "62"-"73", the embouchure control value is set at "64" in the primary mode and "127" in the secondary mode. In the primary mode, the key code values "62"-"73" are supplied to the tone generator circuit 38 along with the embouchure control value "64" and used to generate tones "$C_3$" and "$C\#_4$". In the secondary mode, the key code values "62"-"73" are supplied to the tone generator circuit 38 along with the embouchure control value "127" and used to generate tones "$D_4$" and "$C\#_5$".

Value "12" is added by an addition process AS to each of the key code values equal to and greater than "74" so that the key code value is converted to a key code value one octave higher than the unconverted key code value. For example, the key codes values "74" to "85" corresponding to "$D_3$" to "$C\#_5$" are converted to key code values "86" to "97", respectively, that correspond to "$D_5$" to "$C\#_6$". The thus-converted key codes are each supplied to the tone generator circuit 38 along with the embouchure control value "64" and used to generate a tone of a pitch of "$D_5$" or higher.

Figure 9:
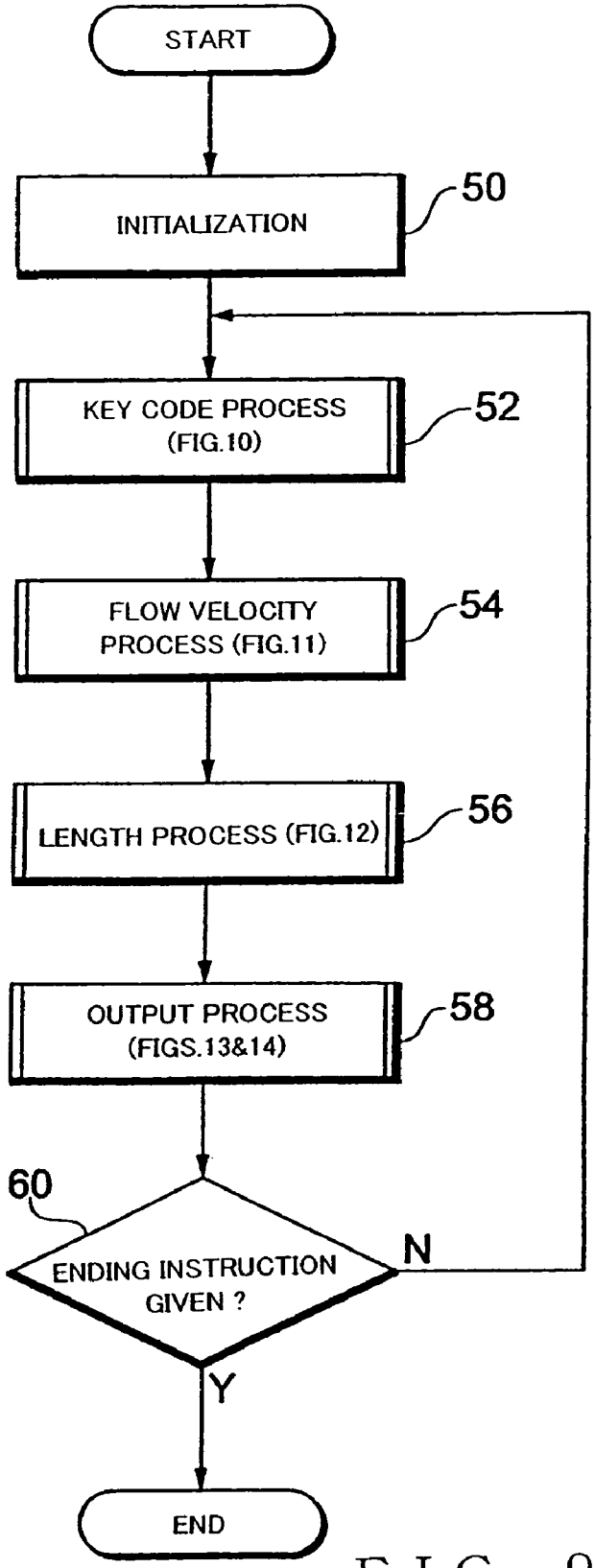
FIG. 9 is a flow chart showing an example operational sequence of a main routine.

FIG. 9 is a flow chart showing an example operational sequence of a main routine, which is started up, for example, in response to powering-on of the electronic wind instrument. Predetermined initialization process is performed at step 50. For example, at step 50, a value "0" is set to the above-mentioned registers KCR, BCR, EMR and PAR, and a value "0" indicative of a silent state is set to a mode flag MF in the RAM 26.

At step 52, a key code process is performed on the basis of fingering data supplied from the key switch circuit 36, as will be later detailed in relation to FIG. 10. At next step 54, a flow velocity process is performed on the basis of flow velocity data supplied from the flow velocity sensor circuit 32, as will be later detailed in relation to FIG. 11. At step 56, a length process is performed on the basis of length data supplied from the length sensor circuit 34, as will be later detailed in relation to FIG. 12. At step 58, an output process is performed for outputting various control information to the tone generator circuit 38, as will be later detailed in relation to FIGS. 13 and 14.

Following step 58, a determination is made at step 60 as to whether any ending instruction, such as an instruction for turning off the tone generator, has been given. With a negative (N) determination at step 60, the main routine reverts to step 52 to repeat the processes at and after step 52. When an affirmative (Y) determination has been made at step 60, the main routine is brought to an end.

Figure 10:
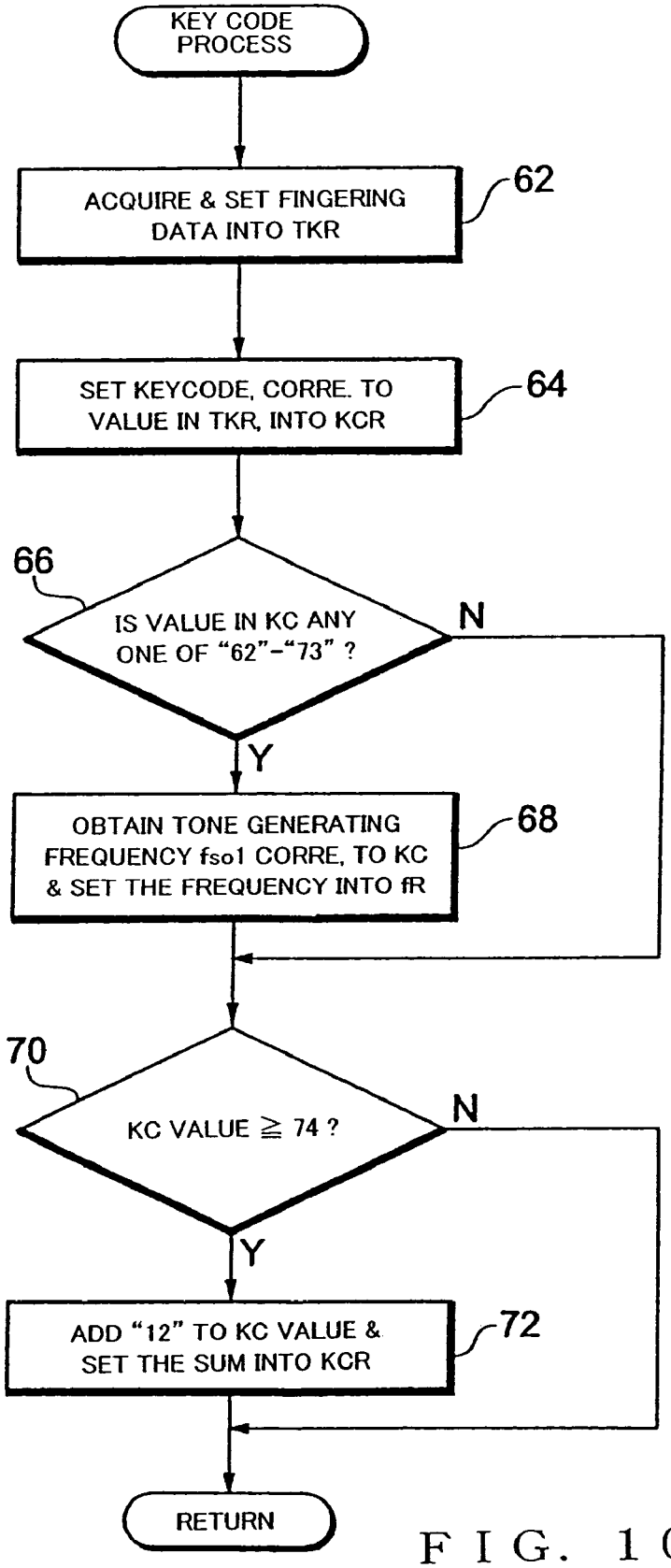
FIG. 10 is a flow chart showing a key code process subroutine.

FIG. 10 is a flow chart showing the key code process subroutine. At step 62, fingering data is acquired from the key switch circuit 36 and set into the register TKR within the RAM 26. In the ROM 24, there is prestored a key code table indicating a key code, like that shown in (A) of FIG. 8, for each fingering pattern or state indicated by such fingering data. At step 64, a key code corresponding to the fingering data value currently set in the register TKR is obtained with reference to the key code table of the ROM 24 and then set into the register KCR.

At next step 66, a determination is made as to which the KC (key code) value currently set in the register KCR is any one of "62" to "73" ("$D_3$" to "$C\#_4$"), i.e. whether the current tone generation mode is the primary or secondary mode. In the ROM 24, there is prestored a frequency table indicative of a frequency of a tone signal of a predetermined pitch name of a predetermined octave which is to be generated in accordance with each KC value. If an affirmative (Y) determination has been made at step 66, it means that the current tone generation mode is the primary or secondary mode, so that a frequency Fso1 corresponding to the KC value set in the register KCR is obtained with reference to the frequency table of the ROM 24 and then set into a register fR within the RAM 26.

With a negative (N) determination at step 66 (meaning that the current tone generation mode is other than the primary or secondary mode) or upon completion of the operation at step 68, a further determination is made at step 70 as to whether the KC value set in the register KCR is equal to or greater than 74 ($D_4$). With an affirmative (Y) determination at step 70, the subroutine moves on to step 72, where a value "12" is added to the KC value set in the register KCR and then data indicative of the resultant sum is set into the register KCR; this operation corresponds to the addition process AS shown in FIG. 8. Upon completion of the operation at step 72 or with a negative (N) determination at step 70, the subroutine returns to the main routine of FIG. 9.

Figure 11:
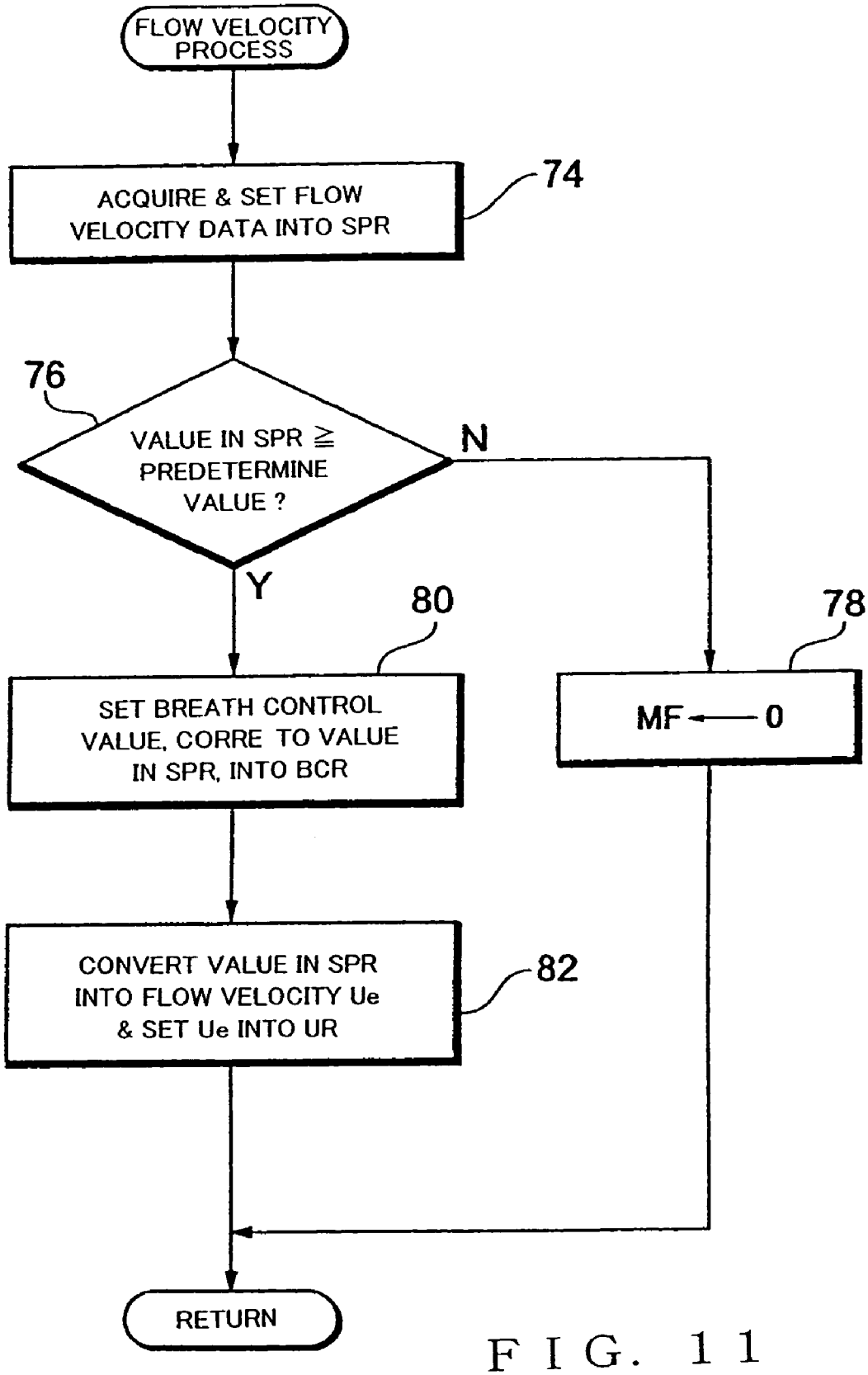
FIG. 11 is a flow chart showing a flow velocity process subroutine.

FIG. 11 is a flow chart showing the flow velocity process subroutine. At step 74, flow velocity data is acquired from the flow velocity sensor circuit 32 and then set into the register SPR within the RAM 26. Then, at step 76, a determination is made as to whether the flow velocity data value is equal to or greater than a predetermined value. Value suitable for permitting tone generation by the instrument is preset as the above-mentioned predetermined value. With a negative (N) determination at step 76, a value "0" (representing a silent state) is set at step 78 into the mode flag MF.

With an affirmative (A) determination at step 76, the subroutine moves on to step 80. In the ROM 24, there is also prestored a breath table indicative of a breath control value for each flow data value. At step 80, a breath control value corresponding to the flow velocity data value set in the register SPR is obtained with reference to the breath table of the ROM 24 and then set into the register BCR. In the ROM 24, there is also prestored a flow velocity table indicative of a flow velocity Ue (corresponding to U(d) of FIG. 6) at the edge EG for each flow velocity data. At step 82, the flow velocity data value set in the register SPR is converted into a flow velocity Ue at the edge EG with reference to the flow velocity table of the ROM 24 and then set into a register UR within the RAM 26. Upon completion of the operation at step 78 or 82, the subroutine returns to the main routine of FIG. 9.

Figure 12:
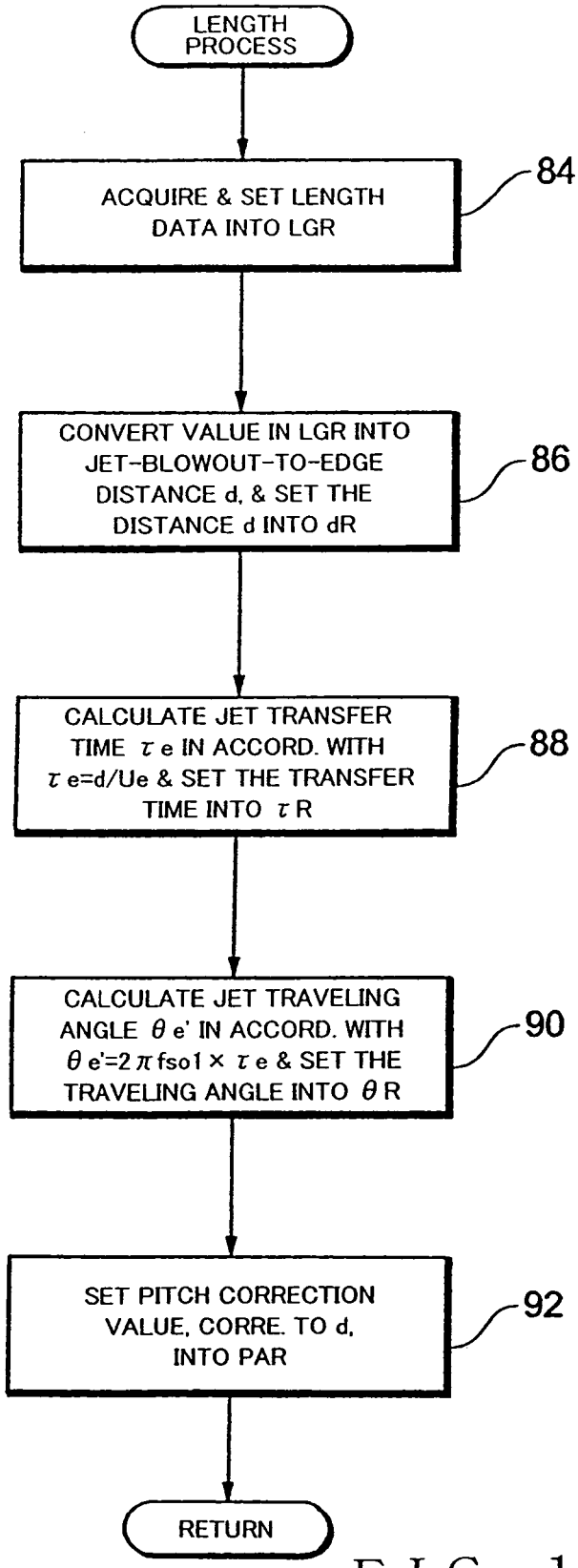
FIG. 12 is a flow chart showing a length process subroutine.

FIG. 12 is a flow chart showing the length process subroutine. At step 84, length data is acquired from the length sensor circuit 34 and then set into a register LGR within the RAM 26. In the ROM 24, there is also prestored a distance table indicating a distance d between the jet blowout outlet and the edge EG (i.e., jet-blowout-outlet-to-edge distance d) for each length data value. At step 86, the length data value set in the register LGR is converted onto a jet-blowout-outlet-to-edge distance d, and distance data indicative of the converted distance d is set into a register dR within the RAM 26.

Then, at step 88, a jet transfer time $\tau e$ is calculated in accordance with a mathematical expression of "$\tau e=d/Ue$" using the jet flow velocity Ue indicated by the flow velocity data set in the register UR and distance d indicated by the distance data set in the register dR, and then time data indicative of the thus-calculated jet transfer time $\tau e$ is set into a register $\tau R$ within the RAM 26. Whereas step 88 has been described as calculating the jet transfer time $\tau e$ using the simplified method ($M_4$) of the aforementioned jet transfer calculation methods ($M_1$)-($M_4$), the jet transfer time $\tau e$ may be calculated using any one of the other methods ($M_1$)-($M_3$).

At next step 90, a jet traveling angle $\theta e'$ is calculated in accordance with a mathematical expression of "$\theta e'=2\pi fso1\times \tau e$" using the jet transfer time $\tau e$ indicated by the time data set in the register $\tau R$ and frequency fso1 indicated by the frequency data set in the register fR, and then traveling angle data indicated by the thus-calculated jet traveling angle $\theta e'$ is set into a register $\tau R$ within the RAM 26. In the ROM 24, there is also prestored a pitch table indicative of a pitch correction value for each distance d obtained at step 86. At following step 92, a pitch correction value corresponding to the distance d indicated by the distance data set in the register dR is obtained with reference to the pitch table, and the thus-obtained pitch correction value is set into the register PAR. After that, the subroutine returns to the main routine of FIG. 9.

Figure 13:
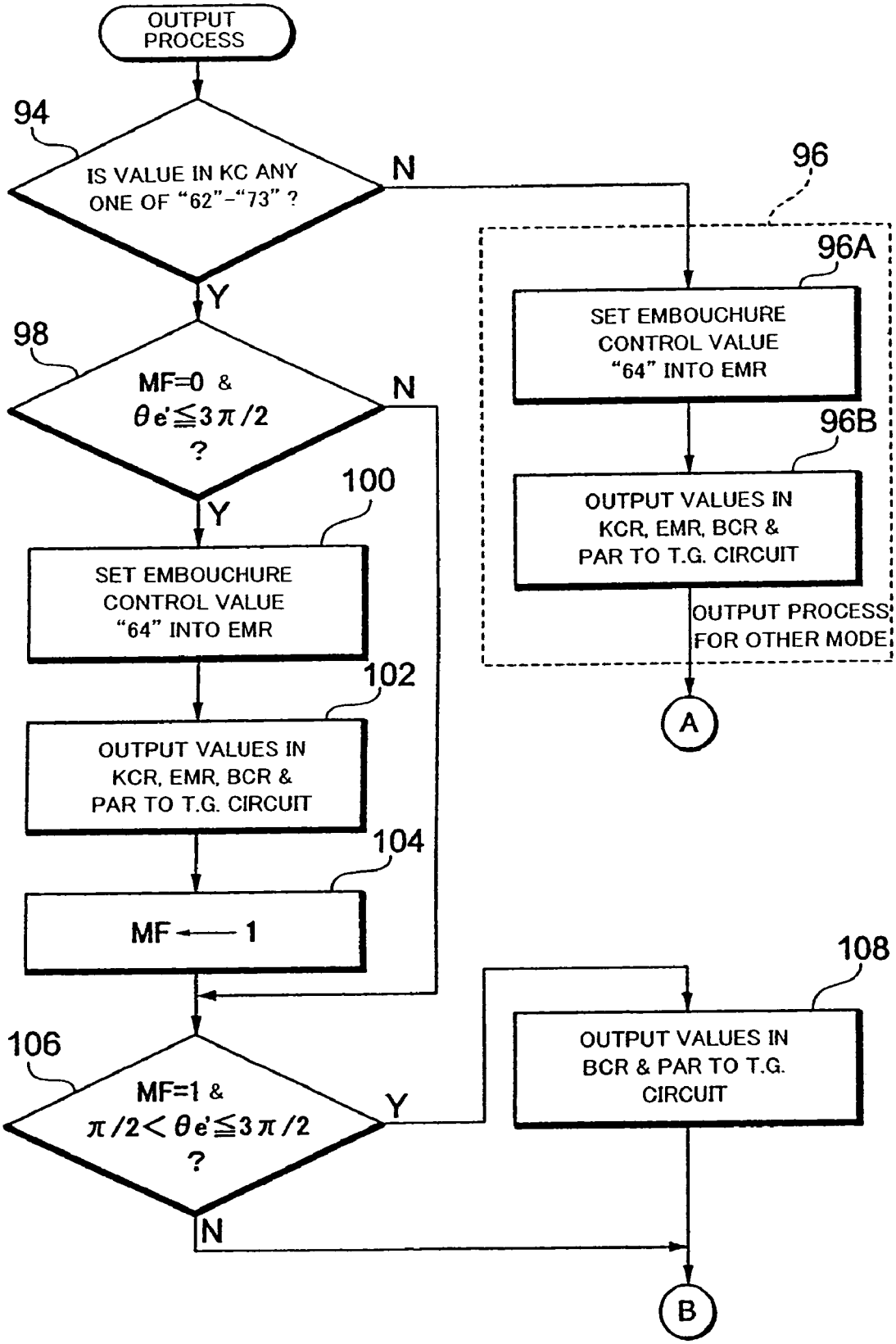
FIG. 13 is a flow chart showing a part of an output process subroutine.
Figure 14:
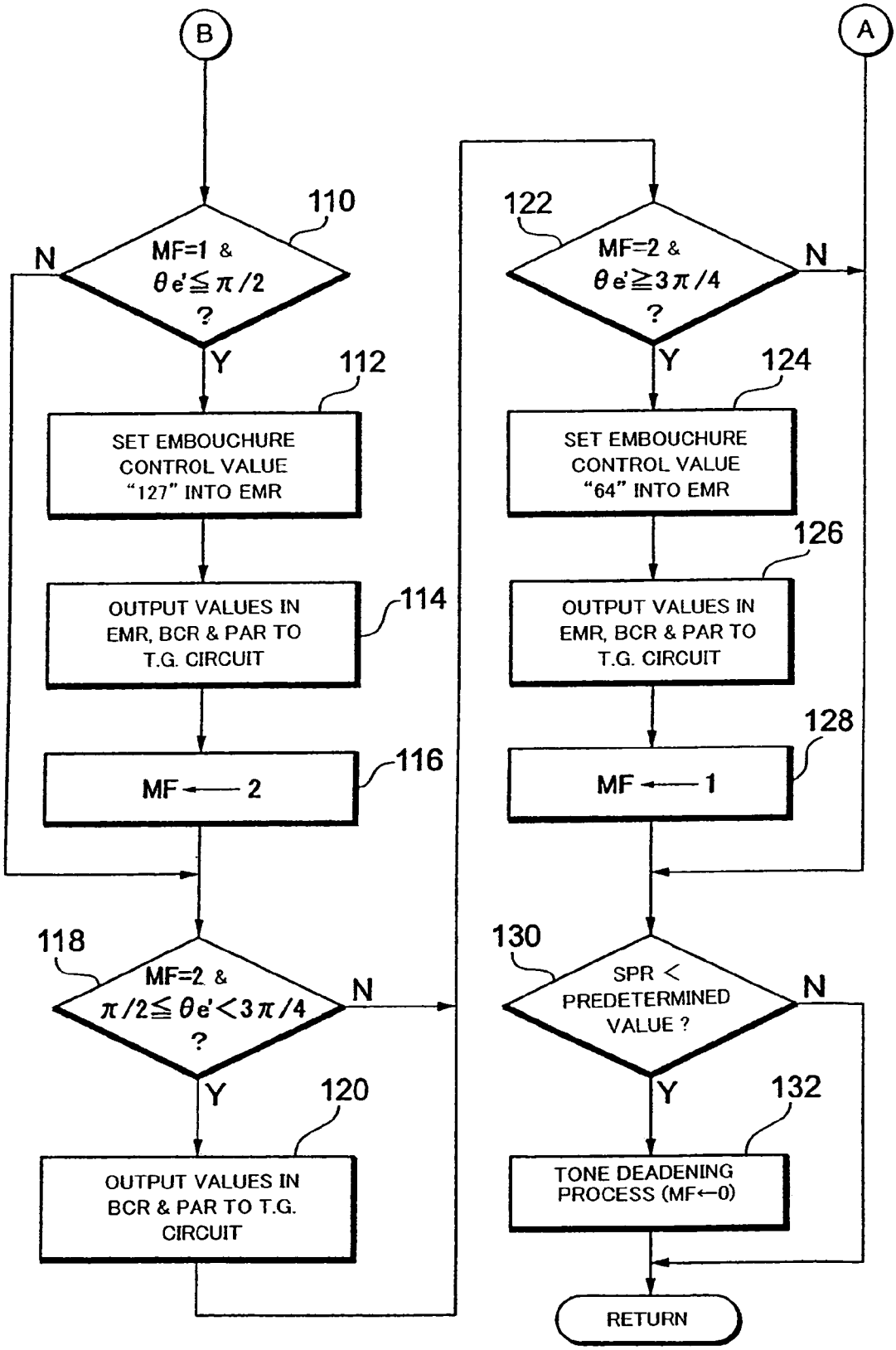
FIG. 14 is a flow chart showing the remaining part of the output process subroutine.

FIGS. 13 and 14 are a flow chart showing the output process subroutine. At step 94, a determination is made as to which the KC value currently set in the register KCR is any one of "62" to "73", i.e. whether the current tone generation mode is the primary or secondary mode. If a negative (N) determination has been made at step 94, it means that the KC value is any one of "60", "61" and "74" and over (i.e., the current tone generation mode is other than the primary and secondary modes), so that the output process for the other mode is carried out at step 96.

Namely, at step 96A, the embouchure control value is set into the register EMR. Then, at step 96B, the KC value, embouchure control value, breath control value and pitch correction value currently set in the registers KCR, EMR, BCR and PAR, respectively, are output to the tone generator circuit 38. As a consequence, a tone whose KC value is any one of "60", "61" and "74" and over is generated, and the volume and color of the tone are controlled in accordance with the breath control value while the pitch of the tone is controlled in accordance with the pitch correction value.

After the output operation of step 96, the subroutine goes to step 130 of FIG. 14. At step 130, a determination is made as to whether the flow velocity data currently set in the register SPR is smaller than the predetermined value mentioned above in relation to step 76 of FIG. 11. With a negative (N) determination at step 130, the subroutine returns to the main routine of FIG. 9, while, with an affirmative (A) determination at step 130, a tone deadening process is performed at step 132, where a value "0" is set to each individual control input of the physical model tone generator 38A and to each of the registers KCR, BCR, EMR and PAR. Also, a value "0" indicating a silent state is set to the mode flag MF. As a consequence, attenuation of the currently-generated tone is started, so that generation of a new tone is permitted. After step 132, the subroutine returns to the main routine of FIG. 9.

If an affirmative (Y) determination has been at step 94, it means that the current mode is the primary or secondary mode, so that the subroutine moves on to step 98. At step 98, a determination is made as to whether the mode flag MF is currently at the value "0" and the jet traveling angle $\theta e'$ has reduced to $3\pi/2$. With an affirmative (Y) determination at step 98, the embouchure value "64" is set, at step 100, into the register EMR.

At step 102, the KC value, embouchure control value, breath control value and pitch correction value currently set in the registers KCR, EMR, BCR and PAR are output to the tone generator circuit 38, in the same manner as set forth above in relation to step 96B. As a consequence, a tone of any one of "$D_3$" to "$C\#_4$" is generated when the jet traveling angle $\theta e'$ has reduced to $3\pi/2$ in the silent state, and the volume and color of the tone are controlled in accordance with the breath control value while the pitch of the tone is controlled in accordance with the pitch correction value. Then, at step 104, a value "1" (representing the primary mode) is set into the mode flag MF.

Upon completion of the operation at step 104 or with a negative (N) determination at step 98, the subroutine proceeds to step 106, where it is determined whether the value currently set in the mode flag MF is "1" and the jet traveling angle $\theta e'$ is equal to or smaller than $3\pi/2$ and greater than $\pi/2$. With an affirmative (Y) determination at step 106, the subroutine proceeds to step 108, where the breath control value set in the register BCR and the pitch correction value set in the register PAR are output to the tone generator circuit 38. In this way, it is possible to gradually raise the tone generating frequency and vary the tone volume and color by increasing the flow velocity and reducing the distance d when the jet traveling angle $\theta e'$ is in the range of "$\pi/2<\theta e'\leqq 3\pi/2$", as shown in FIG. 7.

Figure 15:
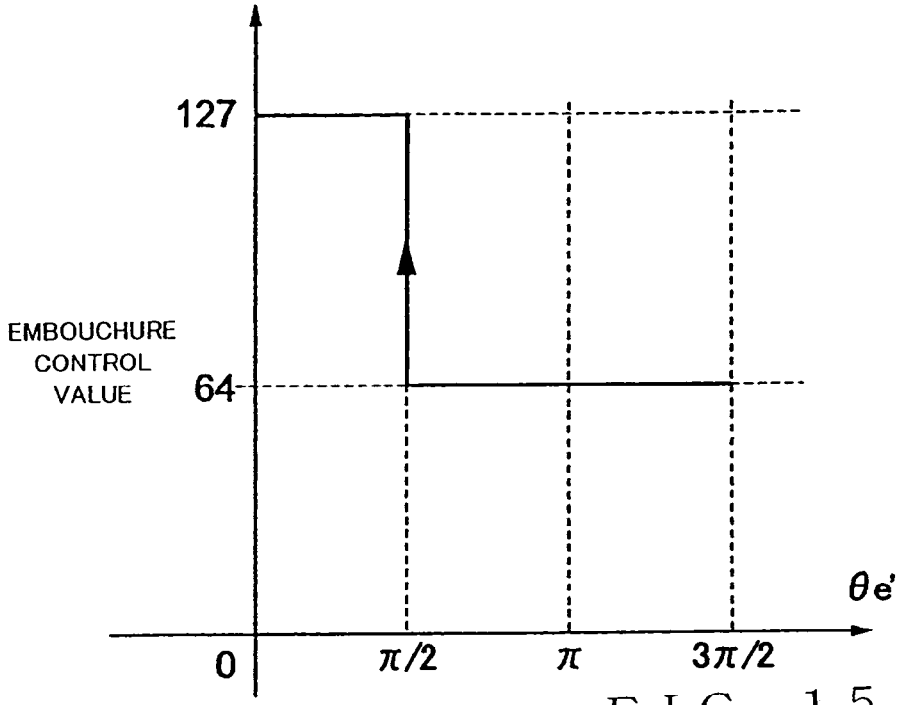
FIG. 15 is a graph showing relationship between a jet traveling angle and embouchure control value at the time of an octave rise.

Upon completion of the operation at step 108 or with a negative (N) determination at step 106, the subroutine proceeds to step 110 of FIG. 14, where it is determined whether the value currently set in the mode flag MF is "1" and the jet traveling angle $\theta e'$ has decreased to $\pi/2$. With an affirmative (Y) determination at step 110, the embouchure control value "127" is set into the register EMR at step 112. The embouchure control value changes from "64" to "127" when the jet traveling angle $\theta e'$ has decreased to $\pi/2$, as shown in FIG. 15. With a negative (N) determination at step 110, on the other hand, the subroutine moves to step 118.

At step 114, the embouchure control value, breath control value and pitch correction value currently set in the registers EMR, BCR and PAR are output to the tone generator circuit 38. As a consequence, the mode jumps from the primary mode to the secondary mode at the point $S_4$, as shown in FIG. 7, so that the tone generating octave gets higher by one octave. Further, the volume and color of the tone are controlled in accordance with the breath control value, while the pitch of the tone is controlled in accordance with the pitch correction value. Then, at step 116, a value "2" (representing the secondary mode) is set into the mode flag MF.

Next, at step 118, a determination is made as to whether the value currently set in the mode flag MF is "2" and the jet traveling angle $\theta e'$ is equal to or greater than $\pi/2$ and smaller than $3\pi/4$. With an affirmative (Y) determination at step 118, the subroutine proceeds to step 120, where the breath control value and pitch correction value set in the registers BCR and PAR are output to the tone generator circuit 38 as at step 108.

In this way, it is possible to gradually lower the tone generating frequency and vary the tone volume and color by lowering the flow velocity and increasing the distance d when the jet traveling angle θe' is in the range of "$\pi/2<\theta e'\leqq 3\pi/4$", as shown in FIG. 7.

Figure 16:
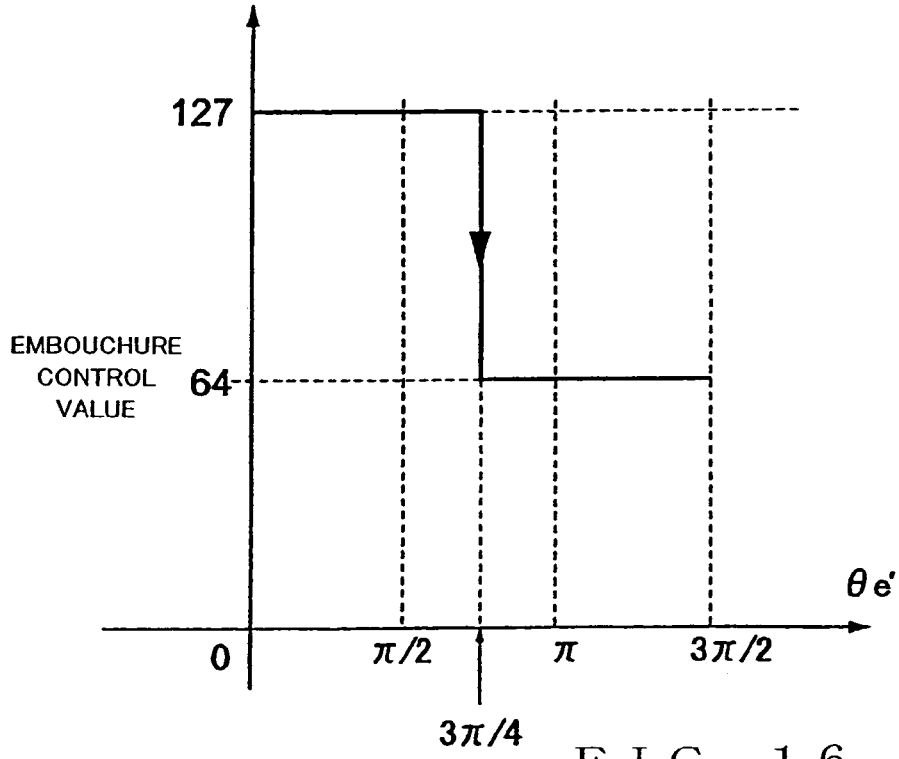
FIG. 16 is a graph showing relationship between a jet traveling angle and embouchure control value at the time of an octave fall.

Upon completion of the operation at step 120 or with a negative (N) determination at step 118, the subroutine proceeds to step 122, where it is determined whether the value currently set in the mode flag MF is "2" and the jet traveling angle θe' has increased up to $3\pi/4$. With an affirmative (Y) determination at step 122, the embouchure control value "64" is set into the register EMR at step 124. The embouchure control value changes from "127" to "64" when the jet traveling angle θe' has increased up to $3\pi/4$, as shown in FIG. 16.

At step 126, the embouchure control value, breath control value and pitch correction value currently set in the registers EMR, BCR and PAR are output to the tone generator circuit 38, as at step 114. As a consequence, the mode jumps from the secondary mode to the primary mode at the point $S_8$, as shown in FIG. 7, so that the tone generating octave lowers by one octave. Further, the volume and color of the tone are controlled in accordance with the breath control value, while the pitch of the tone is controlled in accordance with the pitch correction value. Then, at step 128, a value "1" is set into the mode flag MF.

As set forth above, a determination is made, at step 130, as to whether the flow velocity data currently set in the register SPR is smaller than the predetermined value, With an affirmative (A) determination at step 130, a tone deadening process is performed at step 132 as set forth above. Upon completion of the operation of step 132 or with a negative (N) determination at step 130, the subroutine returns to the main routine of FIG. 9.

As set forth above, the instant embodiment is arranged in such a manner that, in making the determinations at steps 98, 106, 110, 118 and 122, the jet traveling angle θe' is used as a jet parameter and compared to a numerical value having "π", such as $3\pi/2$". Alternatively, a numerical value that does not have "π", such as $2fso1\times\tau$, may be used as the jet parameter, and a numerical value that does not have "π", such as 3/2, may be used as a comparison reference value to be compared with the jet parameter.

The above-described embodiment allows two tones, having the same pitch name but different in octave, to be performed properly with ease using the same fingering state, by just changing the flow velocity Ue and distance d. If the octave shift has no hysteresis, octave variation tends to occur easily due to a vibrato or the like, which would invite a difficulty with performance. However, the instant embodiment is arranged to impart a hysteresis to the octave shift, and thus it permits a pitch bend or vibrato rendition style when the jet traveling angle θe' is in the range of "$\pi/2<\theta e'\leqq 3\pi/4$" or "$\pi/2\leqq\theta e'<3\pi/4$". Further, if a tone one octave higher is performed with tonguing (i.e., a technique of starting blowing breath air into the instrument after stopping the breath air with the tongue) rather than with a slur (i.e., a technique of changing the fingering state while maintaining a same air-blowing state), there would be encountered a difficulty with performance as with a flute, because the tonguing involves a weak breath state and a desired tone is generated by way of a tone produced one octave lower at attack and release phases. Thus, the instant embodiment can deal with embouchures of various flute-performing methods and therefore suits users who want to enjoy performance close to performance of a flute. Note that, whereas the preferred embodiment has been described above as using a flow velocity sensor to obtain the breath control value and flow velocity Ue at the edge EG, there may be used a pressure sensor that detects an intensity of the air jet.

Next, a description will be given about a modification of the processing performed in the above-described embodiment. According to the modification, the main routine is arranged in the manner as described above in relation to FIG. 9, but the key code process of FIG. 10, flow velocity process of FIG. 11, length process of FIG. 12 and output process of FIGS. 13 and 14 are modified as illustrated in FIGS. 17, 18, 19 and 20, respectively.

Figure 17:
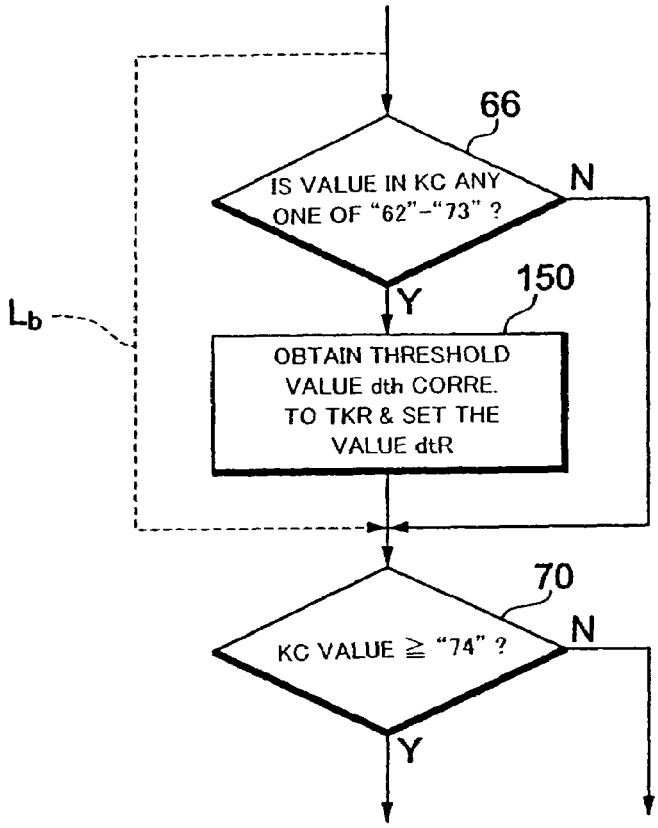
FIG. 17 is a flow chart showing a modification of the key code process subroutine.

In the modified key code process, control proceeds to step 150 of FIG. 17 when an affirmative determination has been made at step 66 of FIG. 10. In the ROM 24, there is prestored a threshold value table indicative of an octave-switching controlling threshold value for each fingering data value set in the register TKR. As an example, the octave-switching controlling threshold value may be set to get smaller as the tone pitch becomes higher. Octave-switching controlling threshold value dth corresponding to the fingering data value currently set in the register TKR is obtained with reference to the threshold value table of the ROM 24 and then set into a register dtR within the RAM 26. Upon completion of the operation at step 150 or with a negative determination at step 66, the subroutine returns to the main routine of FIG. 9 after carrying out the operations at and after step 70 of FIG. 10.

Figure 18:
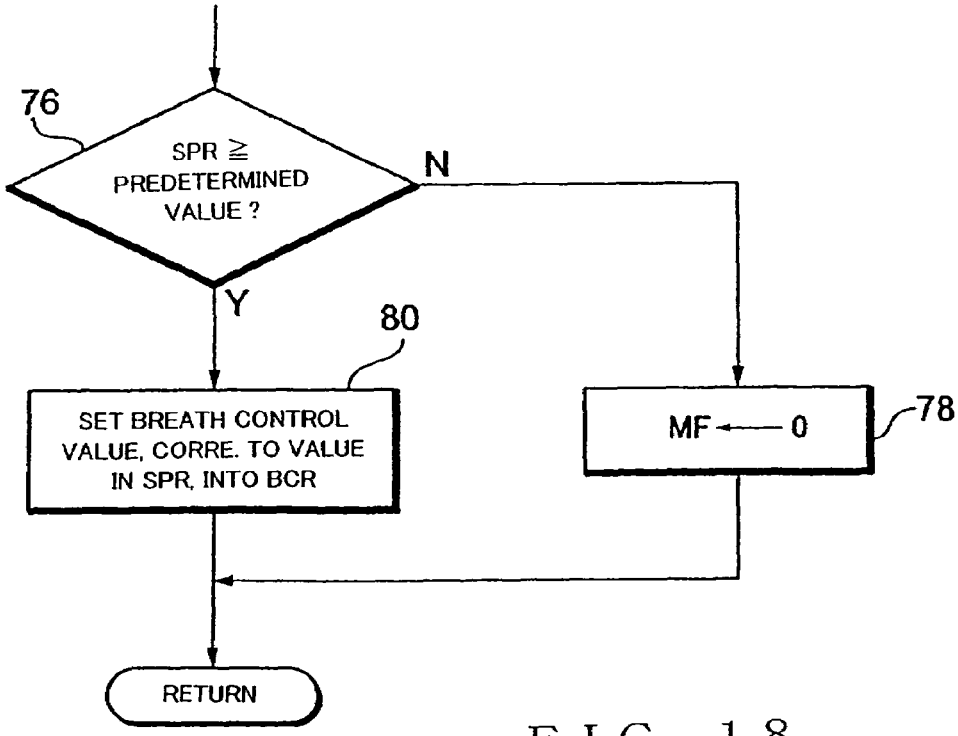
FIG. 18 is a flow chart showing a modification of the flow velocity process subroutine.

In the modified jet velocity process, control returns to the main routine of FIG. 9 after the operations of steps 76, 78 and 80 of FIG. 11 are carried out with the operation of step 82 skipped, as seen in FIG. 18. Namely, the operation of step 82 is unnecessary because the flow velocity Ue at the edge EG is not used in the modification.

Figure 19:
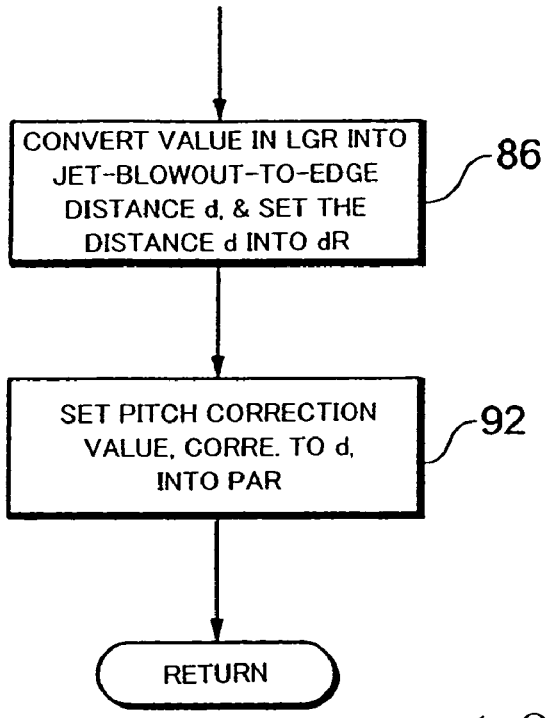
FIG. 19 is a flow chart showing a modification of the length process subroutine.

In the modified length process, control returns to the main routine of FIG. 9 after the operation of step 86 and then the operations of steps 92 of FIG. 12 are carried out with the operations of steps 88 and 90 skipped, as seen in FIG. 19. Namely, the operations of steps 88 and 90 are unnecessary because the jet transfer time τe and jet traveling angle θe' are not used in the modification.

In the modified output process, the output process for the other mode than the primary and secondary mode is carried out at step 96 in the aforementioned manner, upon a negative determination at step 94 of FIG. 13.

Upon an affirmative determination at step 94, a determination is made, at step 152, as to whether the value current set in the mode flag MF is "0" and the flow velocity data value is equal to or greater than a predetermined value. With an affirmative determination at step 152, the operations of steps 100 and 102 of FIG. 13 are carried out in the aforementioned manner. As a consequence, a tone is generated from a silent state, and the volume, color and pitch of the tone are controlled, after which "1" (representing the primary mode) is set to the mode flag MF at step 104.

Upon completion of the operation at step 104 or with a negative (N) determination at step 152, a determination is made, at step 154, as to whether the value currently set in the mode flag MF is "1" and the distance d has decreased to the threshold value dth. The threshold value dth used for the determination here is the one set into the register dtR at step 150 of FIG. 17.

Figure 21:
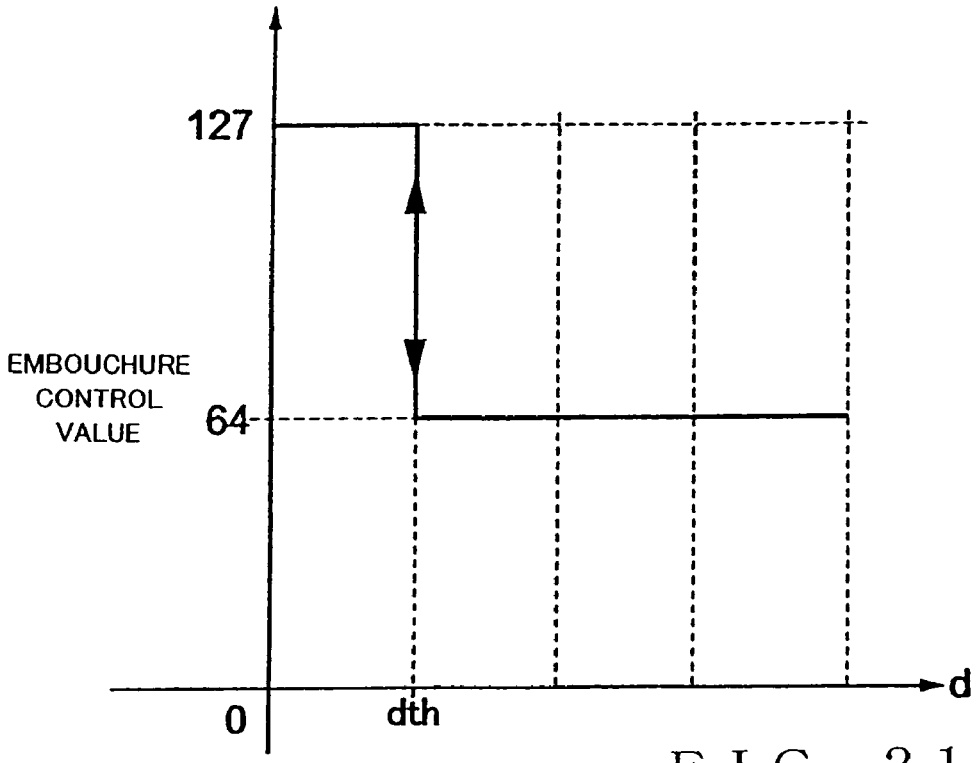
FIG. 21 is a graph showing relationship between a jet traveling angle and embouchure control value employed in the modified processing.

With an affirmative determination at step 154, the operations of steps 112 and 114 of FIG. 14 are carried out in the aforementioned manner. As a consequence, the embouchure control value changes from "64" to "127", so that the tone generating octave gets higher by one octave. In FIG. 21, variation in the embouchure control value at the time of the octave rise is indicated by an upward arrow. After that, "2" (representing the secondary mode) is set to the mode flag MF at step 116.

Upon completion of the operation at step 116 or with a negative determination at step 154, a further determination is made, at step 156, as to whether the value currently set in the mode flag MF is "2" and the distance d has increased above the threshold value dth. The threshold value dth used for the determination here is the one set into the register dtR at step 150 of FIG. 17.

With an affirmative determination at step 156, the operations of steps 124 and 126 of FIG. 14 are carried out in the aforementioned manner. As a consequence, the embouchure control value changes from "127" to "64", so that the tone generating octave falls by one octave. In FIG. 21, variation in the embouchure control value at the time of the octave fall is indicated by a downward arrow. After that, "1" is set to the mode flag MF at step 128, and then the operations at and after step 130 of FIG. 14 are carried out in the aforementioned manner.

With the above-described modified processing, where the tone generating octave is raised by one octave when the jet-blowout-outlet-to-edge distance d has decreased to the threshold value dth but lowered by one octave when the jet-blowout-outlet-to-edge distance d has increased above the threshold value dth, proper octave-specific playing styles are permitted by just changing the lip-to-edge distance, which is very suitable for beginners. Further, because the jet flow velocity does not get involved in octave switching, the modified processing permits a great-tone-volume performance in a low pitch range and a small-tone-volume performance in a high pitch range. Furthermore, because the threshold value dth is set in accordance with the fingering state, the modified processing is suitable for users familiar with the method of changing the lip-to-edge distance in accordance with the tone pitch.

Figure 20:
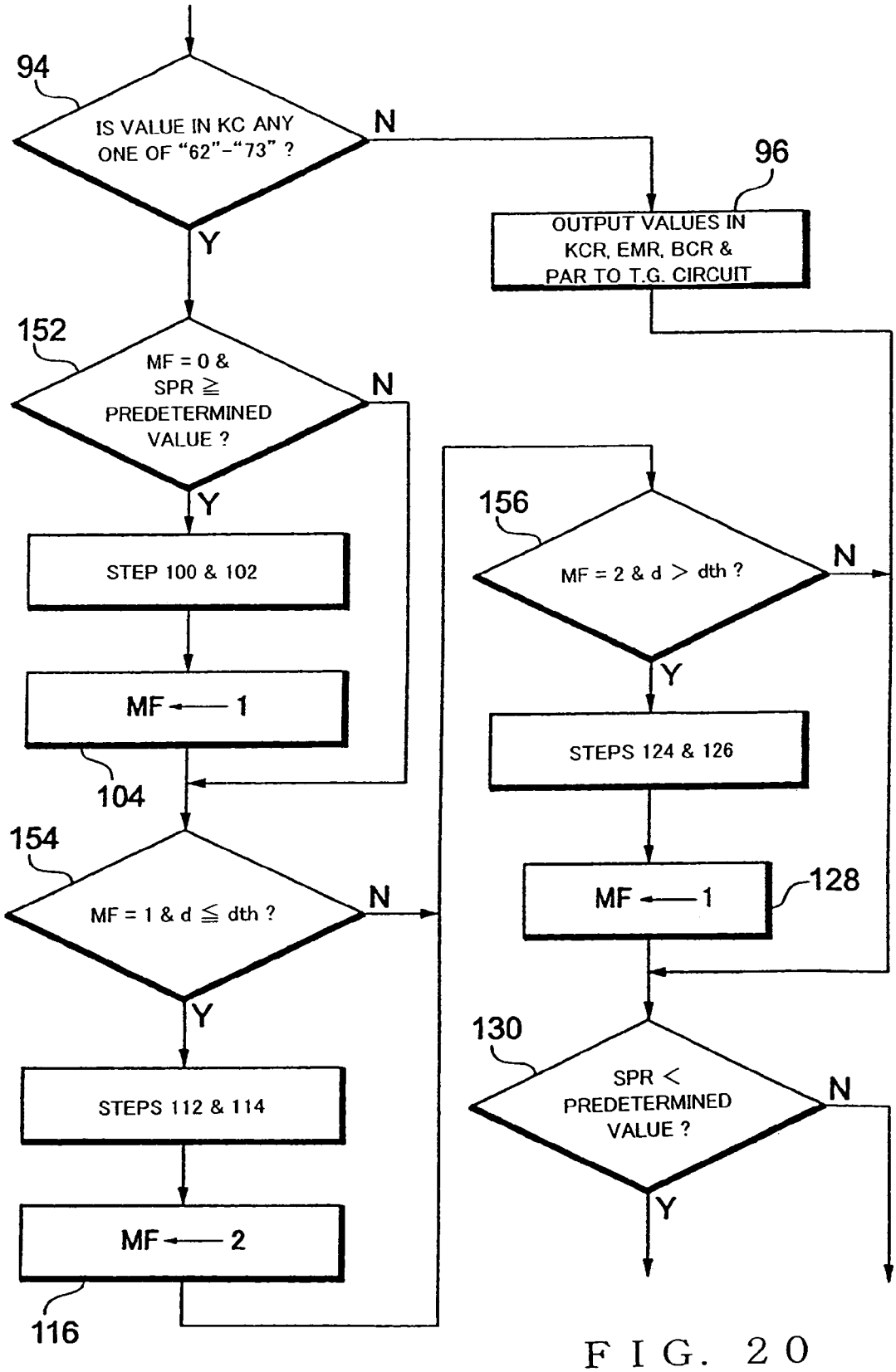
FIG. 20 is a flow chart showing a modification of the output process subroutine.
Figure 22:
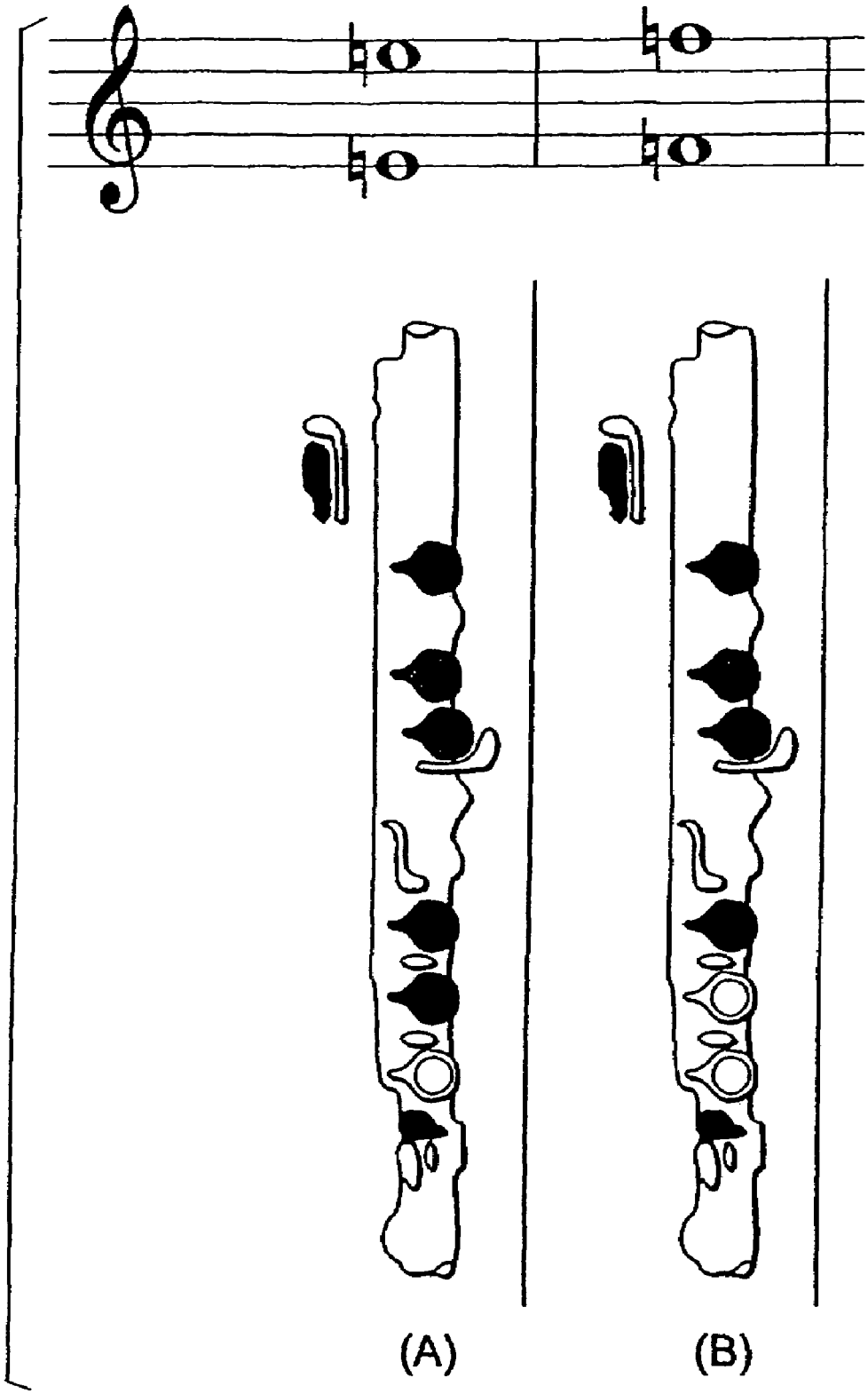
FIG. 22 is a fingering chart explanatory of an example playing style for sounding two tones, having a same pitch name but different in octave, with a same fingering pattern or state.

As another modification, the operations of steps 66 and 150 may be omitted from the key code process of FIG. 17, as indicated by a dotted line. According to this modification, the flow velocity process and length process are performed in the manners as described above in relation to FIGS. 18 and 19, respectively. In the output process, however, the threshold value dth to be used for determinations at steps 154 and 156 of FIG. 20 is fixed at a constant value (e.g., an average of ½ and ¾=⅝=0.625) that does not depend on the fingering. In this way, proper octave-specific playing styles are permitted only by changing the lip-to-edge distance regardless of the fingering state, and thus, this modification is even more suitable for beginners.

Whereas the above-described processing of FIGS. 1-14 (processing (A)), modified processing (processing (B)) and other modified processing (processing (C)) may be performed in respective independent electronic wind instruments, these processing (A)-(C) may be selectively performed in a single electronic wind instrument. As an example, these processing (A)-(C) may be displayed on the display device 30 of FIG. 1 so that the user can select via the display any one of these processing (A)-(C) for execution. In this way, the user is allowed to select a suitable playing method in accordance with his or her level of proficiency and thereby enjoy playing.

Figure 3:
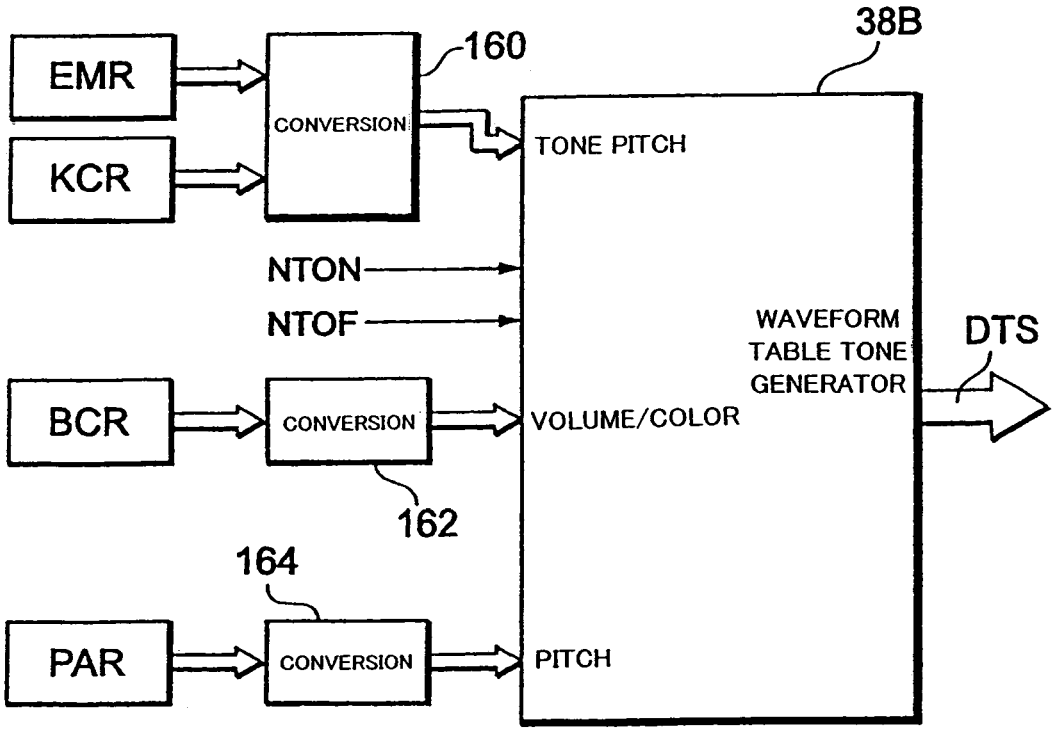
FIG. 3 is a block diagram showing another example of the tone generator circuit.

In the case where the waveform table tone generator 38B shown in FIG. 3 is employed in the above-described embodiments as the tone generator of the tone generator circuit 38, conversion circuits 160, 162 and 164 are provided. When the embouchure control value in the register EMR is "64", the conversion circuit 160 supplies the KC value in the register KCR, which is any one of "60"-"73" and "86" and over, directly to the tone generator 38B, as shown in (B) of FIG. 8. But, when the embouchure control value in the register EMR is "127", the conversion circuit 160 adds "12" to the KC value which is any one of "62"-"73" to thereby convert the KC value into any one of "74"-"85" and then supplies the converted KC value to the tone generator 38B as a tone pitch control input. Thus, the tone generator 38B generates a tone signal of any one of "$D_4$" and "$C\#_5$" on the basis of the KC value which is any one of "74"-"85".

The conversion circuit 162 converts the breath control value in the register BCR into tone volume/color control information and supplies the thus-converted tone volume/color control information to the tone generator 38B as a volume/color control input. The conversion circuit 164 converts the pitch correction value in the register PAR into pitch control information and supplies the thus-converted pitch control information to the tone generator 38B as a pitch control input. Note that these conversion circuits 160-164 may be implemented as conversion processes performed by a computer. As another alternative, control information corresponding to the outputs of the conversion circuits 160-164 may be supplied from the computer to the tone generator 38B, instead of the conversion circuits 160-164 or conversion processes being used.

To the tone generator 38B is also supplied note-on information NTON for starting generation of a tone and note-off information NTOF for starting attenuation of the tone. The note-on information NTON may be generated through a determination operation similar to step 152 of FIG. 20, while the note-off information NTOF may be generated through a determination operation similar to step 130 of FIG. 14.

When the octave is to be raised by one octave, a tone in the secondary mode may be generated in response to note-on information while a tone in the primary mode is attenuated in response to note-off information. Further, when the octave is to be lowered by one octave, a tone in the primary mode may be generated in response to note-on information while a tone in the secondary mode is attenuated in response to note-off information. In either case, amplitude decrease and increase may be controlled smoothly through so-called crossfade control, in order to prevent undesired discontinuity between the tone to be attenuated and the tone to be generated.

What is claimed is:

1. A tone generator control apparatus comprising:

a tubular body section having an elongated cavity communicating with an open end thereof, said tubular body section having, on an outer peripheral surface thereof, a lip plate having an embouchure hole communicating with the cavity and a plurality of pitch-designating tone keys;

a first detection section provided, on or near an edge of the lip plate which an air jet from the embouchure hole impinges against, for detecting a flow velocity or intensity of the air jet;

a second detection section provided, on or near the edge of the lip plate, for detecting a length of the air jet;

a jet transfer time determination section that, on the basis of detection outputs of said first detection section and said second detection section, determines a jet transfer time required for transfer of the air jet between a jet blowout outlet and the edge of the lip plate;

a fingering detection section that detects a fingering state on the plurality of tone keys;

a designation section that designates a frequency of a tone signal of a predetermined pitch name of a predetermined octave to be generated in correspondence with the fingering state detected by said fingering detection section;

a calculation section that calculates a jet parameter corresponding to a product between the frequency designated by said designation section and the jet transfer time determined by said determination section;

a first control section that, on the basis of the detection output of said first detection section, controls a tone generator section to generate the tone signal of the predetermined octave;

a second control section that, upon detecting that the jet parameter calculated by said calculation section has decreased to a first predetermined value during generation, by the tone generator section, of the tone signal of the predetermined octave, controls the tone generator section to raise a pitch of the tone signal, currently being generated, by one octave; and a third control section that, upon detecting that the jet parameter calculated by said calculation section has increased to a second predetermined value, greater than said first predetermined value, during generation, by the tone generator section, of the tone signal of the pitch having been raised by one octave, controls the tone generator section to lower the pitch of the tone signal, currently being generated, by one octave.

2. A tone generator control apparatus as claimed in claim 1 wherein said first detection section includes a plurality of flow velocity sensors provided for detecting the flow velocity of the air jet along a jet flow path extending from the jet blowout outlet to the edge or to a region near the edge, and said jet transfer time determination section includes an estimation section that, on the basis of outputs of the plurality of flow velocity sensors, estimates flow velocity distribution of the air jet from the jet blowout outlet to the edge, and a distance determination section that, on the basis of the detection output of said second detection section, determines a distance between the jet blowout outlet and the edge, and wherein said jet transfer time determination section determines the jet transfer time on the basis of the flow velocity distribution estimated by said estimation section and the distance determined by said distance determination section.

3. A tone generator control apparatus as claimed in claim 1 wherein said jet transfer time determination section includes a storage section that stores flow velocity distribution data, indicative of flow velocity distribution of the air jet from the jet blowout outlet to the edge or to a region near the edge, for each detection output value of said first detection section, a readout section that reads out, from the storage section, the flow velocity distribution data corresponding to a detection output value of said first detection section, and a distance determination section that, on the basis of the detection output of said second detection section, determines a distance between the jet blowout outlet and the edge, and wherein said jet transfer time determination section determines the jet transfer time on the basis of the flow velocity distribution indicated by the flow velocity distribution data read out from said storage section and the distance determined by said distance determination section.

4. A tone generator control apparatus as claimed in claim 1 wherein said jet transfer time determination section includes a storage section that stores time data, indicative of a time required for transfer of the air jet between the jet blowout outlet and the edge of the lip plate, for each detection output value of said first detection section and for each detection output value of said second detection section, and a readout section that reads out, from the storage section, the time data corresponding to detection output values of the first and second detection sections, and wherein said jet transfer time determination section determines, as the jet transfer time, the time data read out from the storage section.

5. A tone generator control apparatus as claimed in claim 1 wherein said jet transfer time determination section includes a flow velocity determination section for determining a flow velocity of the air jet at the edge of the lip plate on the basis of the detection output of said first detection section, and a distance determination section that, on the basis of the detection output of said second detection section, determines a distance between the jet blowout outlet and the edge, and wherein said jet transfer time determination section calculates the jet transfer time by dividing the distance determined by said distance determination section by the flow velocity determined by said flow velocity determination section.

6. A tone generator control apparatus as claimed in claim 1 which further comprises:

a fourth control section that, during generation, by the tone generator section, of the tone signal of the predetermined octave, controls the tone generator section to raise the frequency of the tone signal as the jet parameter calculated by said calculation section decreases toward said first predetermined value, and a fifth control section that, during generation, by the tone generator section, of the tone signal of the pitch having been raised by one octave, controls said tone generator section to raise the frequency of the tone signal as the jet parameter calculated by said calculation section increases toward said second predetermined value.

7. A computer-readable medium containing a program for use with a tone generator control apparatus including; a tubular body section having an elongated cavity communicating with an open end thereof, the tubular body section having, on an outer peripheral surface thereof, a lip plate having an embouchure hole communicating with the cavity and a plurality of pitch-designating tone keys; a first detection section provided, on or near an edge of the lip plate which an air jet from the embouchure hole impinges against, for detecting a flow velocity or intensity of the air jet; a second detection section provided, on or near the edge of the lip plate, for detecting a length of the air jet; a fingering detection section that detects a fingering state on the plurality of tone keys; and a computer, said program causing said computer to function as:

a jet transfer time determination section that, on the basis of detection outputs of said first detection section and said second detection section, determines a jet transfer time required for transfer of an air jet between a jet blowout outlet and the edge of the lip plate;

a designation section that designates a frequency of a tone signal of a predetermined pitch name of a predetermined octave to be generated in correspondence with the fingering state detected by said fingering detection section;

a calculation section that calculates a jet parameter corresponding to a product between the frequency designated by said designation section and the jet transfer time determined by said jet transfer time determination section;

a first control section that, on the basis of the detection output of said first detection section, controls a tone generator section to generate the tone signal of the predetermined octave;

a second control section that, upon detecting that the jet parameter calculated by said calculation section has decreased to a first predetermined value during generation, by the tone generator section, of the tone signal of the predetermined octave, controls the tone generator section to raise a pitch of the tone signal, currently being generated, by one octave; and a third control section that, upon detecting that the jet parameter calculated by said calculation section has increased to a second predetermined value, greater than said first predetermined value, during generation, by the tone generator section, of the tone signal of the pitch having been raised by one octave, controls the tone generator section to lower the pitch of the tone signal, currently being generated, by one octave.

8. A tone generator control apparatus comprising: a tubular body section having an elongated cavity communicating with an open end thereof, said tubular body section having, on an outer peripheral surface thereof, a lip plate having an embouchure hole communicating with the cavity and a plurality of pitch-designating tone keys;

a first detection section provided, on or near an edge of the lip plate which an air jet from the embouchure hole impinges against, for detecting a flow velocity or intensity of the air jet;

a second detection section provided, on or near the edge of the lip plate, for detecting a length of the air jet;

a distance determination section that, on the basis of the detection output of said second detection section, determines a distance between the jet blowout outlet and the edge;

a fingering detection section that detects a fingering state on the plurality of tone keys;

a first control section that controls a tone generator section to generate a tone signal of a predetermined pitch of a predetermined octave, corresponding to the fingering state detected by said fingering detection section, on the basis of the detection output of said first detection section;

a second control section that, upon detecting that the distance determined by said distance determination section has decreased to a predetermined value during generation, by the tone generator section, of the tone signal of the predetermined octave, controls the tone generator section to raise a pitch of the tone signal, currently being generated, by one octave; and a third control section that, upon detecting that the distance determined by said distance determination section has increased above the predetermined value during generation, by the tone generator section, of the tone signal of the pitch having been raised by one octave, controls the tone generator section to lower the pitch of the tone signal, currently being generated, by one octave.

9. A tone generator control apparatus as claimed in claim 8 which further comprises a storage section that stores an octave-switching controlling threshold value for each fingering state detected by said fingering detection section; and a supply section that reads out, from the storage section, the threshold value corresponding to the fingering state detected by said fingering detection section and supplies the read-out threshold value to the second and third control sections as the predetermined value.

10. A computer-readable medium containing a program for use with a tone generator control apparatus including; a tubular body section having an elongated cavity communicating with an open end thereof, the tubular body section having, on an outer peripheral surface thereof, a lip plate having an embouchure hole communicating with the cavity and a plurality of pitch-designating tone keys; a first detection section provided, on or near an edge of the lip plate which an air jet from the embouchure hole impinges against, for detecting a flow velocity or intensity of the air jet; a second detection section provided, on or near the edge of the lip plate, for detecting a length of the air jet; a fingering detection section that detects a fingering state on the plurality of tone keys; and a computer, said program causing said computer to function as:

a distance determination section that, on the basis of the detection output of said second detection section, determines a distance between the jet blowout outlet and the edge;

a first control section that controls a tone generator section to generate a tone signal of a predetermined pitch of a predetermined octave, corresponding to the fingering state detected by said fingering detection section, on the basis of the detection output of said first detection section;

a second control section that, upon detecting that the distance determined by said distance determination section has reached a predetermined value during generation, by the tone generator section, of the tone signal of the predetermined octave, controls the tone generator section to raise a pitch of the tone signal, currently being generated, by one octave; and a third control section that, upon detecting that the distance determined by said distance determination section has deviated from the predetermined value during generation, by the tone generator section, of the tone signal of the pitch having been raised by one octave, controls the tone generator section to lower the pitch of the tone signal, currently being generated, by one octave.

* * * * *